US010732578B2

(12) United States Patent
Fujisawa

(10) Patent No.: US 10,732,578 B2
(45) Date of Patent: Aug. 4, 2020

(54) ELECTRONIC TIMEPIECE

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/805,478

(22) Filed: Nov. 7, 2017

(65) Prior Publication Data

US 2018/0129169 A1 May 10, 2018

(30) Foreign Application Priority Data

Nov. 8, 2016 (JP) ..... 2016-218020
May 15, 2017 (JP) ..... 2017-096822

(51) Int. Cl.

| | |
|---|---|
| ***G04R 20/00*** | (2013.01) |
| ***G04R 20/02*** | (2013.01) |
| ***G04R 60/12*** | (2013.01) |
| ***G04G 21/04*** | (2013.01) |
| ***G04R 20/04*** | (2013.01) |
| ***G04R 60/14*** | (2013.01) |
| *G04G 17/08* | (2006.01) |

(52) U.S. Cl.

CPC ..... *G04R 20/02* (2013.01); *G04G 21/04* (2013.01); *G04R 20/04* (2013.01); *G04R 60/12* (2013.01); *G04R 60/14* (2013.01); *G04G 17/08* (2013.01)

(58) Field of Classification Search

CPC ..... G04R 20/02; G04R 60/12; G04R 20/04; G04R 60/14; G04G 21/04; G04G 17/08

See application file for complete search history.

(56) References Cited

U.S. PATENT DOCUMENTS

| | | | | |
|---|---|---|---|---|
| 2002/0190689 | A1* | 12/2002 | Nakamura | G04C 10/00 320/102 |
| 2011/0051561 | A1* | 3/2011 | Fujisawa | G04G 5/002 368/47 |
| 2012/0002511 | A1* | 1/2012 | Matsuzaki | G04G 21/04 368/10 |
| 2012/0002512 | A1* | 1/2012 | Matsuzaki | G04C 10/02 368/47 |
| 2012/0213039 | A1* | 8/2012 | Aizawa | G04R 20/04 368/47 |

(Continued)

FOREIGN PATENT DOCUMENTS

| | | |
|---|---|---|
| JP | 2004-534240 A | 11/2004 |
| JP | 2010-096523 A | 4/2010 |

(Continued)

*Primary Examiner* — Sean Kayes
(74) *Attorney, Agent, or Firm* — Harness, Dickey & Pierce, P.L.C.

(57) ABSTRACT

Provided is an electronic timepiece that receives satellite signals more easily when satellite signal is received automatically. The electronic timepiece has a time display that displays time by the position indicated by a rotating first hand; a planar antenna that receives satellite signal transmitted wirelessly from a satellite; a receiver connected to the planar antenna; and a controller that operates the receiver when a specific condition is met. The planar antenna includes a dielectric substrate, and an antenna patch disposed to the substrate. The center of the patch antenna being disposed in the range between 6:00 and 11:00 on the time display.

10 Claims, 17 Drawing Sheets

(56) References Cited

U.S. PATENT DOCUMENTS

| | | | | |
|---|---|---|---|---|
| 2013/0009816 | A1* | 1/2013 | Hagita | G04R 20/02<br>342/357.52 |
| 2015/0268636 | A1* | 9/2015 | Sawada | G04R 20/02<br>368/47 |
| 2015/0378313 | A1* | 12/2015 | Abe | G04R 60/10<br>368/205 |
| 2016/0049721 | A1* | 2/2016 | Aizawa | H01Q 1/273<br>343/718 |

FOREIGN PATENT DOCUMENTS

| | | | |
|---|---|---|---|
| JP | 2013-050349 | A | 3/2013 |
| JP | 2015-175738 | A | 10/2015 |
| WO | WO-2003-005485 | A1 | 1/2003 |

* cited by examiner

ELECTRONIC TIMEPIECE

BACKGROUND

1. Technical Field

The present invention relates to an electronic timepiece having an antenna.

2. Related Art

JP-T-2004-534240 describes an electronic timepiece that receives RF satellite signals transmitted from GPS (Global Positioning System) satellites. The disclosed electronic timepiece has a patch antenna, which is a planar antenna, as the antenna used to receive the satellite signals. This electronic timepiece is referred to below as an electronic timepiece with planar antenna.

JP-T-2004-534240 is silent regarding opportunities to start receiving satellite signals. As a result, for an electronic timepiece with planar antenna to start receiving satellite signals based on a user operation burdens the user with manually performing a specific operation. An electronic timepiece with planar antenna therefore preferably receives satellite signals automatically.

When an electronic timepiece with planar antenna executes the satellite signal reception process automatically (also referred to below as automatic reception), and the timepiece is worn on the user's wrist, satellite signals are often actually received when the user (electronic timepiece) is outdoors because when the timepiece is indoors the strength of the received satellite signals is weak. In this situation, the arm of the user on which the electronic timepiece with planar antenna is worn is typically hanging down at the side (referred to below as the arm-down posture).

An electronic timepiece with planar antenna, when in the automatic reception mode, is more likely to execute the satellite signal reception process when the user is outdoors in the arm-down posture.

It is therefore desirable for an electronic timepiece with planar antenna configured to automatically receive satellite signals to be able to easily receive satellite signals when the user is outdoors and the electronic timepiece is held in the arm-down posture.

SUMMARY

An electronic timepiece according to the invention is directed to solving the foregoing problem, and enables easily receiving satellite signals when satellite signal reception is executed automatically.

A first aspect of an electronic timepiece according to the invention includes a time display that displays time by the position indicated by a first hand; a planar antenna that receives satellite signal; a receiver connected to the planar antenna; and a controller that operates the receiver when a specific condition is met. The planar antenna includes a dielectric substrate, and an antenna electrode disposed to the substrate; and the center of the antenna electrode is disposed in the range between 6:00 and 11:00 on the time display.

When satellite signal reception executes automatically, the user's arm is often in an arm-down position. In this position, the range between 6:00 and 11:00 on the dial (time display) is likely facing the direction of the satellite signals from which the satellite signals are transmitted.

In this configuration, the center of the antenna electrode is in the range between 6:00 and 11:00 on the time display unit. As a result, the gain of the planar antenna increases in the range between 6:00 and 11:00 on the time display.

Compared with a configuration in which the center of the antenna electrode is disposed outside the range between 6:00 and 11:00 on the time display, when the user is in the arm-down posture, the direction in which the gain of the planar antenna increases easily matches the direction in which the satellites can be found. Satellite signal reception is therefore easier when satellite signal is received automatically.

An electronic timepiece according to another aspect of the invention preferably also has a timekeeper that keeps an internal time; and the specific condition is the internal time reaching a specific time.

If a time when the likelihood that the user will be outdoors is set as the specific time, this configuration can further increase the possibility of being able to automatically receive satellite signal.

In an another aspect of the invention, the electronic timepiece preferably also has an outdoor detector that detects whether or not the electronic timepiece is outdoors; and the specific condition is the outdoor detector determining the electronic timepiece is outdoors.

This configuration enables automatically receiving satellite signal in situations in which the possibility of being able to receive satellite signals is high, that is, when the electronic timepiece is outdoors.

An electronic timepiece according to another aspect of the invention preferably also has a first motor that drives the first hand; an information display that displays specific information by a second hand; and a second motor that drives the second hand; and the planar antenna does not overlap either the first motor or the second motor when seen in plan view from the display surface side of the time display.

This configuration can display both the time and specific information, and can suppress a drop in the reception performance of the planar antenna due to the effects of the first motor and second motor. The thickness of the electronic timepiece can also be reduced.

An electronic timepiece according to another aspect of the invention also has a digital display that digitally displays information; and the planar antenna is disposed not overlapping the digital display when seen in plan view from the display surface side of the time display.

This configuration enables displaying information digitally, and can suppress a drop in the reception performance of the planar antenna due to the effects of the digital display.

An electronic timepiece according to another aspect of the invention also has a solar panel for solar power generation; and the solar panel is notched in the part overlapping the planar antenna when seen in plan view from the display surface side of the time display.

This configuration enables driving the electronic timepiece by photovoltaic power generated by the solar panel. A drop in the reception performance of the planar antenna due to the effects of the solar panel can also be suppressed.

Further preferably, the planar antenna of the electronic timepiece is a patch antenna.

This configuration simplifies satellite signal reception when satellite signal is received automatically by an electronic timepiece configured to receive satellite signal through a patch antenna.

An electronic timepiece according to another aspect of the invention preferably also has a circuit board on which the patch antenna is mounted. The circuit board has a notch appropriate to the shape of a battery used in the electronic timepiece; the patch antenna is a circularly polarized patch antenna; the antenna electrode is a radiating electrode; the circularly polarized patch antenna includes a feed electrode electromagnetically coupled to the radiating electrode, and a ground electrode electrically connected to the circuit board; and the feed electrode contacts the side of the substrate that is closest to the center of the circuit board.

This configuration enables disposing the feed electrode of an electromagnetic coupled-feed, circularly polarized patch antenna near the center of the circuit board. This configuration improves the symmetry of the electromagnetic coupled-feed, circularly polarized patch antenna, and when the satellite signal is circularly polarized, enables efficiently receiving circularly polarized satellite signals from space.

Further preferably in an electronic timepiece according to another aspect of the invention, all of the antenna electrode is disposed in the range between 6:00 and 11:00 on the time display.

This configuration enables more easily receiving satellite signals when satellite signals are received automatically.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. The dimensions and scale of parts shown in the figures differ from the actual dimensions and scale. The following embodiments are specific preferred embodiments of the invention. As a result, the following embodiments have various desirable technical limitations. However, the scope of the invention is not limited to the following embodiments unless specifically stated below.

Embodiment 1

Figure 1:
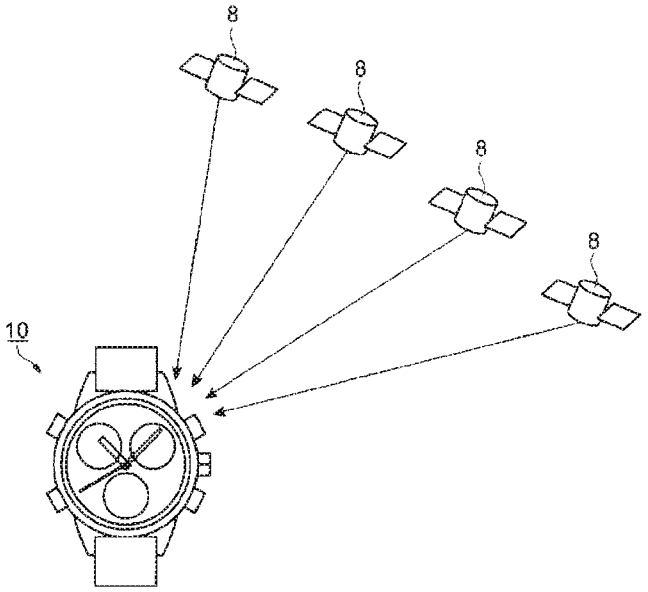
FIG. 1 illustrates a GPS system including an electronic timepiece 10 according to an embodiment of the invention.

FIG. 1 illustrates the general configuration of a GPS system including an electronic timepiece with planar antenna (referred to below as an electronic timepiece) 10 according to this embodiment.

The electronic timepiece 10 in this embodiment of the invention is a wristwatch that receives RF signals transmitted wirelessly from GPS satellites 8 and corrects the kept time of the internal clock (referred to below as RTC 152). A GPS satellite is an example of a satellite. The internal clock (RTC 152) is an example of a timekeeper. The kept time of the internal clock is an example of the internal time as used herein.

The electronic timepiece 10 displays the time, for example, on the opposite side (referred to below as the face) as the side (referred to below as the back) that contacts the wrist.

GPS satellites 8 are navigation satellites the orbit the Earth on specific known orbits. GPS satellites 8 transmit signals (L1 waves) at 1.57542 GHz carrying a superimposed navigation data message to Earth. Below, the signals transmitted at 1.57542 GHz with a superimposed navigation data message are referred to as the satellite signals. The satellite signals are right-hand circularly polarized waves.

There are currently approximately 31 GPS satellites 8 in orbit (only four are shown in FIG. 1). Each GPS satellite 8 superimposes a unique 1023-chip (1 ms) pattern called a C/A code (Coarse/Acquisition Code) on the transmitted satellite signal to enable identifying the GPS satellite 8 that transmitted the satellite signal. Each chip has a value of +1 or −1, and the C/A code appears to be a random pattern.

Each GPS satellite 8 also has an on-board atomic clock. Extremely precise GPS time information kept by the atomic clock is contained in the satellite signal (navigation message). Slight time errors in the atomic clock on each GPS satellite 8 are corrected based on a terrestrial control segment. A time correction parameter for correcting this time difference is included in the satellite signal (navigation message). The electronic timepiece 10 receives the satellite signal transmitted from one GPS satellite 8, and adjusts the internal time of the internal clock to the correct time (time information) obtained using the GPS time information and the time correction parameter contained in the satellite signal.

Orbit information indicating the location of the GPS satellite 8 on its orbit is also contained in the satellite signal. The electronic timepiece 10 can calculate the current position based on the GPS time information and orbit information.

The positioning calculation supposes there is a certain amount of error in the kept time of the internal clock of the electronic timepiece 10. More specifically, in addition to the x, y, z parameters required to identify the location of the electronic timepiece 10 in three-dimensional space, the time error in the kept time of the internal clock of the electronic timepiece 10 is also unknown. The electronic timepiece 10 therefore generally receives satellite signals transmitted from four or more GPS satellites 8, calculates the position based on the GPS time information and orbit information contained in the satellite signals, and thereby acquires positioning information identifying the current location.

Figure 2:
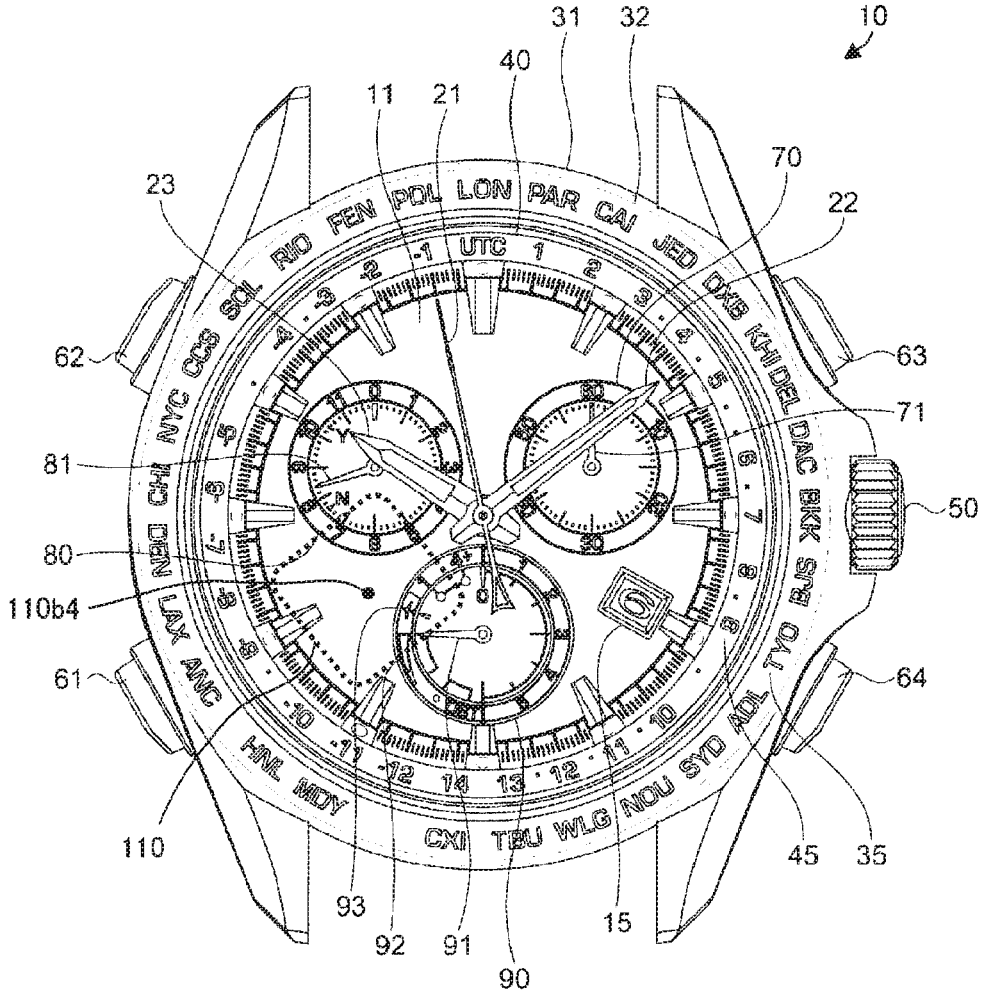
FIG. 2 is a plan view of the electronic timepiece 10.
Figure 3:
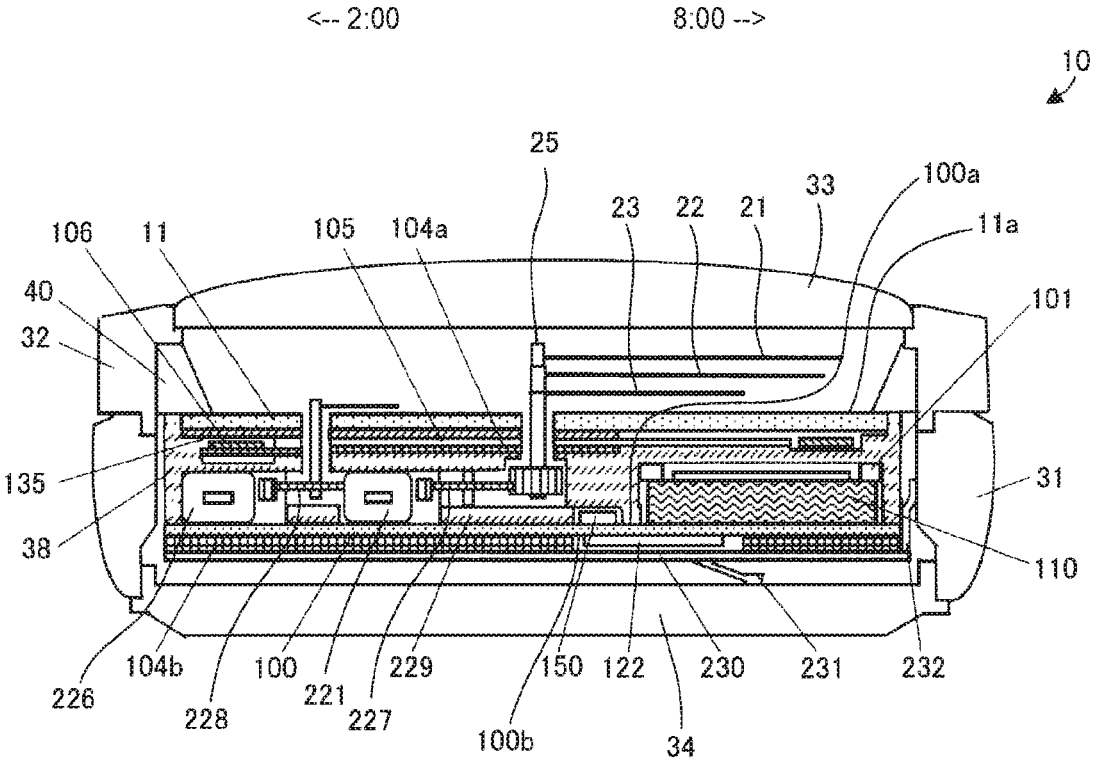
FIG. 3 is a section view through the 2:00 to 8:00 positions of the dial 11 of the electronic timepiece 10.
Figure 4:
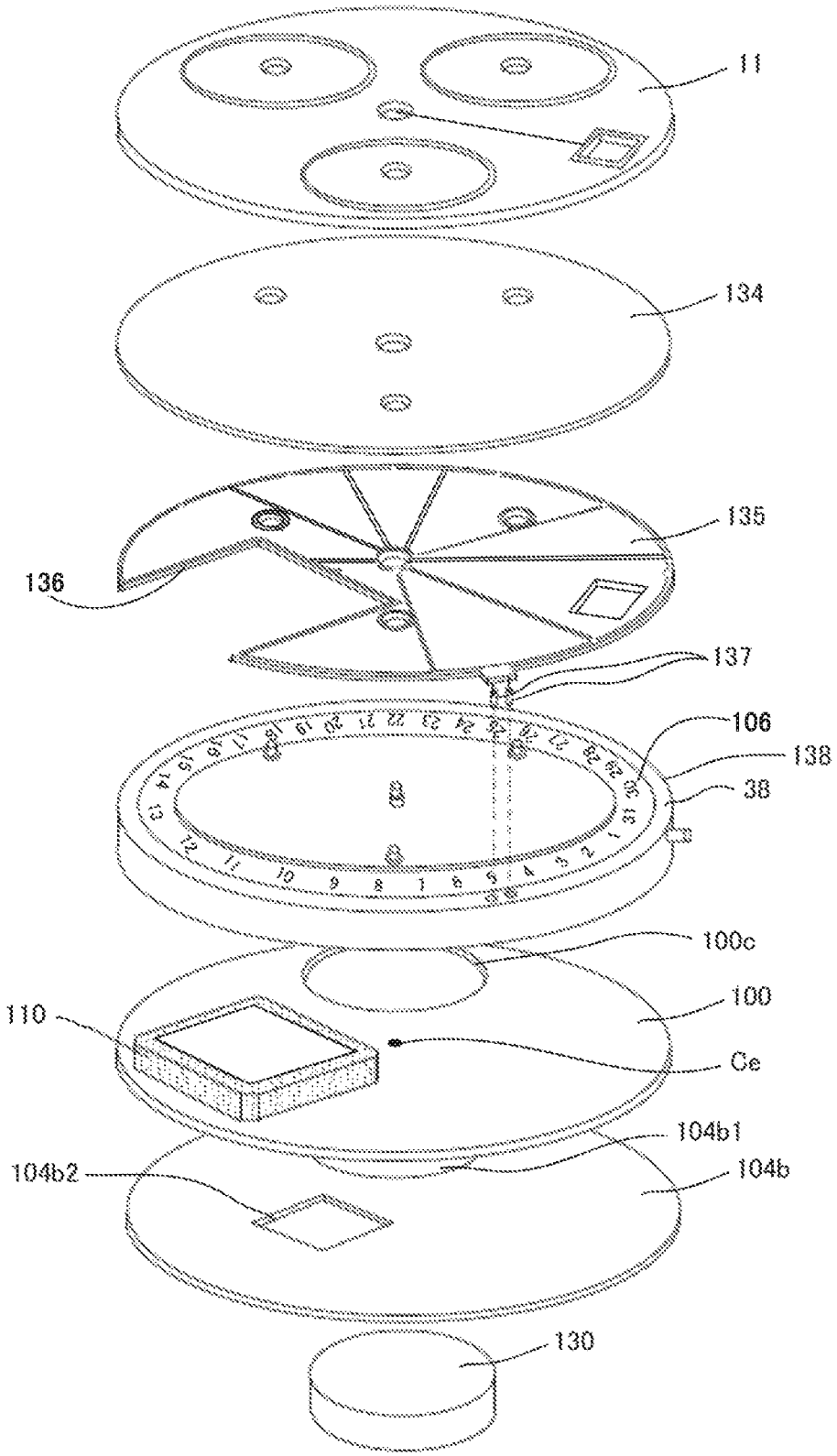
FIG. 4 is an oblique view of part of the electronic timepiece 10.

FIG. 2 is a plan view of the electronic timepiece 10, and FIG. 3 is a section view of part of the electronic timepiece 10 in a line between 2:00 and 8:00. The A button 61 and C button 63 are not shown in FIG. 3. FIG. 4 is a partially exploded oblique view of the electronic timepiece 10.

As shown in FIG. 3, the electronic timepiece 10 has a tubular outside case member 31, bezel 32, crystal 33, and back cover 34. Of the two openings in the case member 31, the opening on the face side is covered by the crystal 33 held by the bezel 32, and the opening on the back cover side is covered by the back cover 34.

The case member 31, bezel 32, and back cover 34 are made of metal, such as stainless steel, titanium, aluminum, or brass. By using a metal back cover 34, the metal case member 31 and the metal back cover 34 are electrically connected, and increase the ground area of the patch antenna 110. As a result, the antenna performance of the patch antenna 110 is improved.

An annular, plastic dial ring 40 is disposed to the inside circumference side of the bezel 32. As shown in FIG. 2, time difference markers 45 indicating the time difference to Coordinated Universal Time (UTC) are formed as numbers or non-numeric symbols on the dial ring 40.

The relationship between UTC, time difference, standard time, and time zones is described next.

A time zone is a geographical region that uses the same standard time throughout. There are currently 40 time zones around the world. Each time zone is defined by the time difference between UTC and the standard time in the time zone. For example, Japan is in a time zone that uses a standard time 9 hours ahead of UTC, that is, a time zone of UTC+9 hours.

Numeric time difference markers 45 indicate the time difference in integers. The non-numeric time difference markers 45 indicate the time difference by symbols other than integers. Coordinated Universal Time, which is the standard for determining the time difference, is denoted by the "UTC" time difference marker 45. Non-integer time differences are denoted by a bullet mark (●) as the time difference marker 45. The UTC and non-integer time differences may obviously be denoted by other symbols.

City markers 35 are also shown on the bezel 32. The city markers 35 indicate the name of a representative city in the time zone using the standard time corresponding to the time difference shown by the time difference marker 45. The city markers 35 in this embodiment of the invention are a three-letter city code, which is a three-letter abbreviation of the name of the city. For example, the code TYO denotes Tokyo. Based on the number 9 of the time difference marker 45 shown on the dial ring 40 at the location of the TYO code, the user can easily know that Tokyo uses a standard time of UTC+9 hours.

A transparent, disc-shaped dial 11 is disposed on the inside circumference side of the dial ring 40. The dial 11 is polycarbonate or other plastic material.

Hands 21, 22, 23 are disposed above the dial 11. The hands 21, 22, 23 rotate on a center pivot 25. The value of the hour of the current time is indicated by hand 23, and the value of the minute of the current time is indicated by hand 22. Hand 23 is also referred to as the hour hand, and hand 22 is also referred to as the minute hand. Hands 22 and 23 are examples of first hands as used herein. The current time is indicated on the dial 11 by the position of the rotating minute hand 22 and the position of the rotating hour hand 23. The dial 11 is an example of a time display.

The value of the second of the chronograph time (stopwatch function) is indicated on the dial 11 by the second hand 21.

Around the center of the dial 11 are further disposed a round first subdial 70 and hand 71 at 2:00; a round second subdial 80 and hand 81 at 10:00; a round third subdial 90 and hand 91 at 6:00; and a rectangular calendar window 15 at 4:00. The first subdial 70, second subdial 80, and third subdial 90 are examples of information display units. Hands 71, 81, 91 are examples of second hands.

The hand 71 of the first subdial 70 indicates the minute of the chronograph (stopwatch) time.

The hand 81 of the second subdial 80 indicates the second of the current time. This hand 81 is also referred to as the second hand.

The minute value to 60 minutes indicated by hand 71, and the value of the second of the current time indicated by the (second) hand 81, are examples of specific information.

A sickle-shaped marker 92 that is wide at the base at 9:00 and narrows to the end at 7:00 is disposed along the outside edge of the third subdial 90 from 7:00 to 9:00. This marker 92 is a power indicator for the storage battery 130 (FIG. 4), and the hand 91 indicates a position at the base, middle, or tip of the marker 92 according to the reserve power in the storage battery 130. A rechargeable lithium ion battery is used as the storage battery 130. The reserve power of the storage battery 130 is another example of specific information.

An airplane-shaped marker 93 is disposed in the area from 9:00 to 10:00 on the outside of the third subdial 90. This airplane marker 93 denotes an in-flight mode. Satellite signal reception is prohibited in some countries by aviation regulations during take-off and landing of an airplane. Satellite signal reception by the electronic timepiece 10 can be stopped by the user operating button A 61 and setting the hand 91 to the airplane marker 93 (in-flight mode).

The dial 11, hands 21, 22, 23, 71, 81, 91, first subdial 70, second subdial 80, third subdial 90, and calendar window 15 can be seen through the crystal 33.

In the side of the case member 31, relative to the dial 11, are disposed an A button 61 at 8:00, B button 62 at 10:00, C button 63 at 2:00, D button 64 at 4:00, and crown 50 at 3:00. Corresponding operating signals (commands) are output when the A button 61, B button 62, C button 63, D button 64, or crown 50 are operated.

A patch antenna 110 for receiving satellite signals is built in to the electronic timepiece 10. This embodiment of the invention uses a circularly polarized patch antenna as the patch antenna 110. The patch antenna 110 is also referred to as a microstrip antenna. The patch antenna 110 is an example of a planar antenna.

Figure 5A:
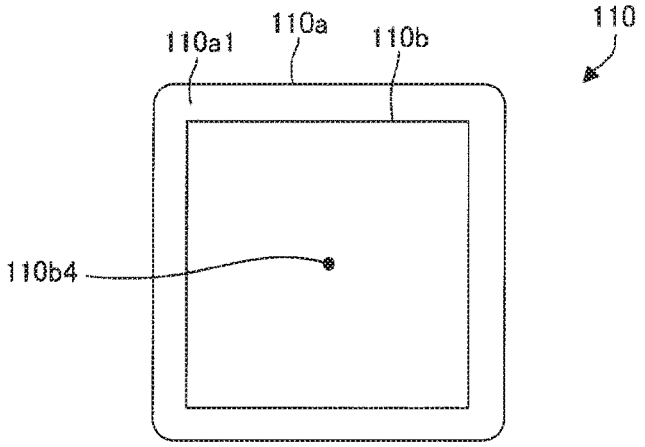
FIG. 5A is a top view of an example of a patch antenna 110.
Figure 5B:
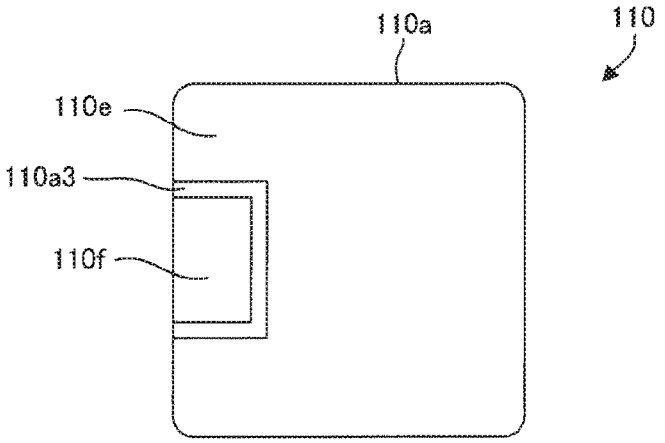
FIG. 5B is a bottom view of an example of a patch antenna 110.

FIG. 5A shows an example of a patch antenna 110, and more specifically is a top view of the patch antenna 110. FIG. 5B is a bottom view of the patch antenna 110. The patch antenna 110 includes a multi-sided substrate 110*a*, antenna patch 110*b*, ground electrode 110*e*, and feed electrode 110*f*. The antenna patch 110*b*, ground electrode 110*e*, and feed electrode 110*f* are disposed to the substrate 110*a*. The antenna patch 110*b* functions as a radiation patch.

Figure 6A:
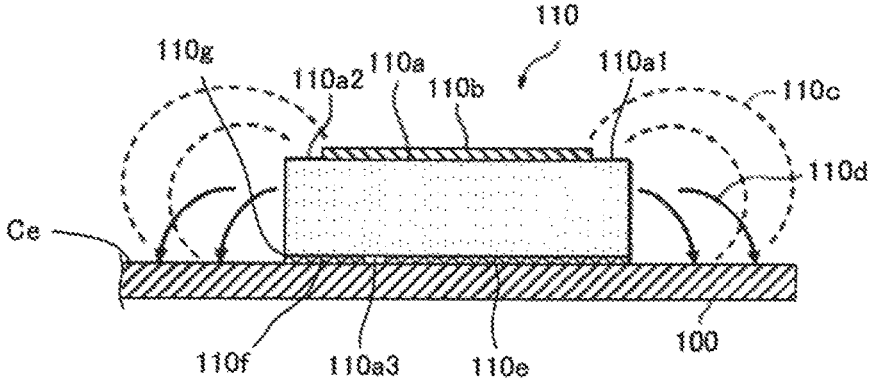
FIG. 6A illustrates the operating principle of the patch antenna 110.

FIG. 6A illustrates the operating principle of the patch antenna 110.

Dotted lines 110*c* represent the radio waves sent or received by the patch antenna 110 (referred to below as simply radio waves). Arrows 110*d* represent electric lines of force.

When the patch antenna 110 is rectangular, one side of the antenna patch 110*b* resonates at half the wavelength of the radio waves. When the patch antenna 110 is circular, the diameter of the antenna patch 110*b* resonates at approximately 0.58 wavelength. If the substrate 110*a* is made from a ceramic or other dielectric material, the resonant length of the antenna patch 110*b* can be shortened by the wavelength shortening effect, and a smaller patch antenna 110 can be achieved.

The substrate 110*a* in this example is a dielectric. A ceramic is used as the dielectric. For example, the substrate 110*a* can be made by molding a barium titanate material with a dielectric constant of approximately 100 in the desired shape in a press, and then sintering. The wavelength of the radio waves received by the antenna patch 110*b* can be shortened by the high permittivity of the ceramic substrate 110*a*.

The antenna patch 110*b* is disposed on surface 110*a*1 of the substrate 110*a*. The ground electrode 110*e* and feed electrode 110*f* are formed by screen printing a predominantly silver paste on surface 110*a*3, which is the opposite side of the substrate 110*a* as surface 110*a*1. The ground electrode 110*e* functions as the ground of the patch antenna 110, and is electrically connected to the circuit board 100, which functions as the ground plane.

The feed electrode 110*f* electromagnetically couples with the antenna patch 110*b*. As a result, a feed pin for electrically connecting the feed electrode 110*f* and antenna patch 110*b* can be eliminated.

When the feed electrode 110*f* and antenna patch 110*b* are electrically connected by a feed pin, a through-hole passing from the surface 110*a*1 to the surface 110*a*3 is formed in the substrate 110*a*, the feed pin is inserted to the through-hole, and the feed pin, feed electrode 110*f*, and antenna patch 110*b* are manually soldered and connected. To stabilize the soldered electrical connection between the antenna patch 110*b* and feed pin, the end of the feed pin on the antenna patch 110*b* side protrudes from the surface 110*a*1 on the antenna patch 110*b* side of the substrate 110*a*, and this protruding part is electrically connected to the antenna patch 110*b* by solder.

However, when a feed pin is not used as in this example, a feed pin no longer protrudes from the surface 110*a*1, and the thickness of the substrate 110*a*, and more particularly the thickness of the movement 138 (see FIG. 4) of the electronic timepiece 10, can be reduced.

Furthermore, when such a feed pin is not used, the task of manual soldering can be eliminated, and the patch antenna 110 can be surface mounted by reflow soldering. The mounting (production) cost can therefore be reduced.

When the patch antenna 110 receives radio waves and induced current flows through the antenna patch 110*b* (radiating electrode), current (image current) in the opposite direction cancelling the induced current is induced in the circuit board 100 (ground plane). If the ground plane is large, the effect of the image current is small, and antenna performance improves. As a result, when the circuit board 100 electrically connects to the patch antenna 110 as the ground plane, antenna performance improves compared with when the circuit board 100 is not electrically connected to the patch antenna 110.

Of the multiple sides of the substrate 110*a*, the feed electrode 110*f* contacts the side 110*g* that is closest to the center Ce of the circuit board 100 (see FIG. 4, FIG. 6A). Note that even when the relative positions of the through-hole 100*c* and patch antenna 110 differ as shown in FIG. 6B from the relationship shown in FIG. 4, the feed electrode 110*f* is disposed to contact the side of the substrate 110*a* that is closest to the center Ce of the circuit board 100.

Next, the center Ce of the circuit board 100 is described further.

Figure 6B:
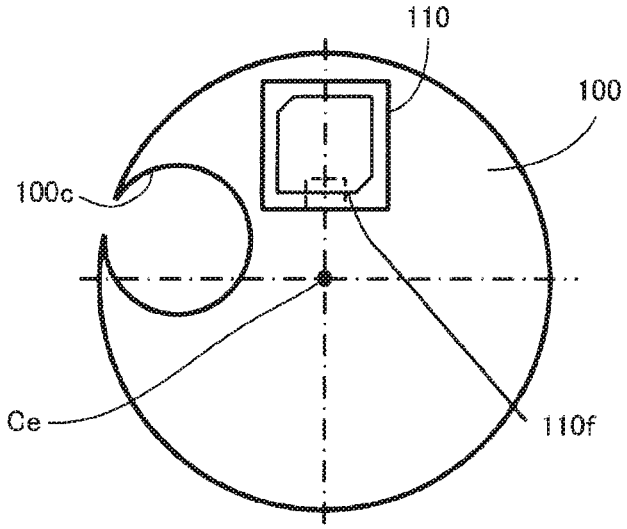
FIG. 6B shows another example of the position of the feed electrode 110*f*.

A through-hole 100*c* corresponding to the shape of the storage battery 130 is formed in the circuit board 100 as shown in FIG. 4 and FIG. 6B. This through-hole 100*c* is an example of a notch. The center of the circuit board 100 (ignoring the through-hole 100*c*) when looking at the circuit board 100 in plan view from the face 11*a* side of the dial 11 (referred to below as simply plan view) as shown in FIG. 2 is used as the center Ce of the circuit board 100. Ignoring the through-hole 100*c*, the circuit board 100 is round in plan view (see FIG. 4). The circuit board 100 may have recesses or protrusions other than the through-hole 100*c*, in which case the center of the circuit board 100 may be decided by approximating a circular shape. In this embodiment of the invention, the center Ce of the circuit board 100 is substantially aligned with the center of the dial 11.

GPS satellites 8 transmit the satellite signals as circularly polarized waves, and the patch antenna 110 receives the circularly polarized waves. If the patch antenna 110 is facing the sky, circularly polarized waves can be received even if the GPS receiver 122 (see FIG. 16) rotates.

If the feed point is located near the center of the ground plane (circuit board 100) in an electromagnetic coupled-feed patch antenna 110, the symmetry (alignment of the feed point with the center of the ground plane) of the patch antenna 110 including the ground plane improves, and circularly polarized waves transmitted from the GPS satellites 8 can be efficiently received.

Because of the through-hole 100*c*, the circuit board 100 in this embodiment is crescent shaped. However, because the storage battery 130 has a metal case and is disposed in the through-hole 100*c*, the patch antenna 110 electrically connected to the circuit board 100 has reception performance that is nearly the same as when the circuit board 100 is round.

Furthermore, a configuration disposing the storage battery 130 in the through-hole 100*c* enables making the electronic timepiece 10 thinner than a configuration in which a through-hole 100*c* is not provided in the circuit board 100 and the storage battery 130 is disposed on the back cover 34 side of the circuit board 100.

The feed electrode 110*f* may also be formed in an L shape so that it is also positioned close to the side 110*g* of the substrate 110*a*. In this case, compared with a configuration having the feed electrode 110*f* only on surface 110*a*3, the distance between the feed electrode 110*f* and antenna patch 110*b* can be shortened, and electromagnetic coupling between the feed electrode 110*f* and antenna patch 110*b* can be strengthened.

Note that of the multiple sides of the substrate 110*a*, the feed electrode 110*f* does not need to contact the side that is closest to the center Ce of the circuit board 100.

The side 110*g* that is disposed to contact the feed electrode 110*f* is also the side that is the farthest of the multiple sides of the substrate 110*a* from the metal case member 31.

As a result, the effect of the metal case member 31 on signal reception by the patch antenna 110 can be minimized, and a drop in antenna gain can be suppressed.

The antenna patch 110*b* (radiating electrode) is positioned closer to the dial 11 than the surface of the storage battery 130 on the dial 11 side.

The patch antenna 110 has strong directivity toward the top (the direction toward the dial 11). As a result, if the surface of the storage battery 130 on the dial 11 side is closer to the dial 11 than the antenna patch 110*b*, the storage battery 130 affects signal reception by the patch antenna 110.

In this embodiment of the invention, however, the antenna patch 110*b* (radiating electrode) is closer to the dial 11 than the dial 11 side surface of the storage battery 130. As a result, the effect of the storage battery 130 on signal reception can be reduced compared with a configuration in which the surface of the storage battery 130 on the dial 11 side is closer to the dial 11 than the antenna patch 110*b*.

When the patch antenna 110 is used as a transmission antenna, a strong electrical field is radiated along the edges of the patch (antenna patch 110*b*) into space from the region 110*a*2 including the edge. As a result, the electric lines of force near the patch antenna 110 become stronger, and the patch antenna 110 becomes more susceptible to the effects of nearby metals and dielectrics.

The patch antenna 110 is therefore affected by the bezel 32 when the bezel 32 is made from a ceramic (dielectric) such as zirconia ($ZrO_2$), titanium carbide (TiC), titanium nitride (TiN), alumina ($Al_2O_3$).

For example, when the bezel 32 is a ceramic bezel, the dielectric constant of the bezel 32 increases 10-40. The ceramic bezel 32 and substrate 110*a* of the patch antenna 110 therefore together produce a wavelength shortening effect, and this wavelength shortening effect enables further reducing the size of the patch antenna 110.

The effect of reducing the size of the patch antenna 110 by using a ceramic bezel 32 is particularly improved if the dielectric constant of the ceramic bezel 32 is 9 or more.

Figure 7:
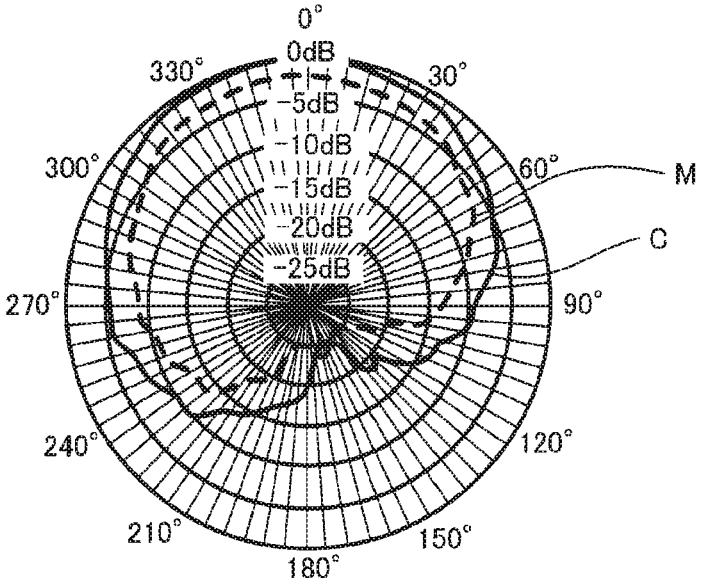
FIG. 7 illustrates the radiation pattern of the electronic timepiece 10.
Figure 8:
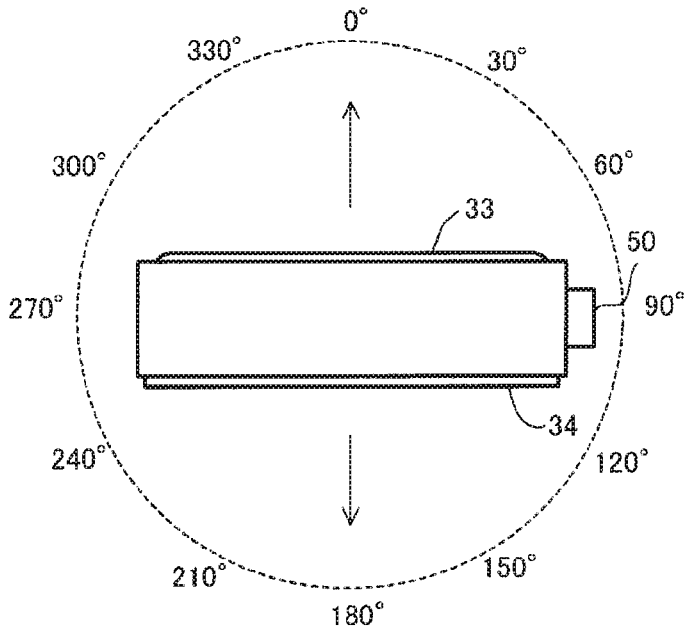
FIG. 8 describes the angles assigned to the electronic timepiece 10.

FIG. 7 compares the radiation pattern perpendicular to the electronic timepiece 10 when a ceramic bezel is used as the bezel 32 and when a metal bezel is used, with the angles shown in FIG. 7 corresponding to the angles shown in FIG. 8 relative to the electronic timepiece 10. Using the angles shown in FIG. 8, 0° is on the crystal 33 side of the electronic timepiece 10, 180° is on the back cover 34 side, and the crown 50 is at 90°.

In FIG. 7, solid line M represents the radiation pattern when a ceramic bezel is used, and dotted line C represents the radiation pattern when a metal bezel is used. As shown in FIG. 7, gain is greater when a ceramic bezel is used than when a metal bezel is used.

Note that ceramic is more expensive than metal because it is hard and difficult to process, but offers greater scratch resistance and maintains a good appearance for a long time.

The center 110*b*4 of the antenna patch 110*b* is disposed in the area between 6:00 and 11:00 on the dial 11. In this embodiment, in plan view, the center 110*b*4 of the antenna patch 110*b* is positioned at 8:00 on the dial 11.

The center 110*b*4 of the antenna patch 110*b* is described next.

(1) When the shape of the antenna patch 110*b* is rectangular (square or not square) in plan view, the center 110*b*4 of the antenna patch 110*b* is at the intersection of the diagonals of the antenna patch 110*b*.

(2) When the shape of the antenna patch 110*b* is round in plan view, the center of the circle is the center 110*b*4 of the antenna patch 110*b*.

(3) When the antenna patch 110*b* is part of a single-feed point patch antenna 110, and in plan view the antenna patch 110*b* has perturbations for tuning or to achieve circular polarization in a rectangular or round antenna patch, the center defined in (1) or (2) above for an antenna patch 110*b* without perturbations is the center 110*b*4 of the antenna patch 110*b*.

Figure 9:
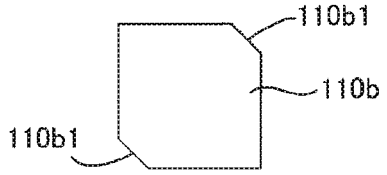
FIG. 9 describes the center of the antenna electrode 110*b*.
Figure 10:
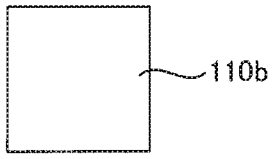
FIG. 10 describes the center of the antenna electrode 110*b*.
Figure 11:
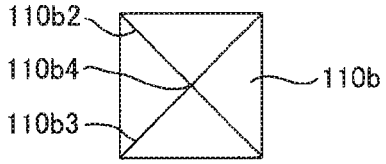
FIG. 11 describes the center of the antenna electrode 110*b*.

For example, if the antenna patch 110*b* is, as shown in FIG. 9, square with truncated corners (truncations) 110*b*1, the shape of the antenna patch 110*b* is first treated as a square, ignoring the truncated corners 110*b*1, as shown in FIG. 10. As shown in FIG. 11, the intersection of the diagonals 110*b*2 and 110*b*3 of that square is the center 110*b*4 of the antenna patch 110*b*. Truncating the corners of the antenna patch 110*b* as shown in FIG. 9 produces a higher resonance frequency complementing the original half wavelength resonance frequency. Combining these two resonance frequencies produces circular polarization.

Figure 12:
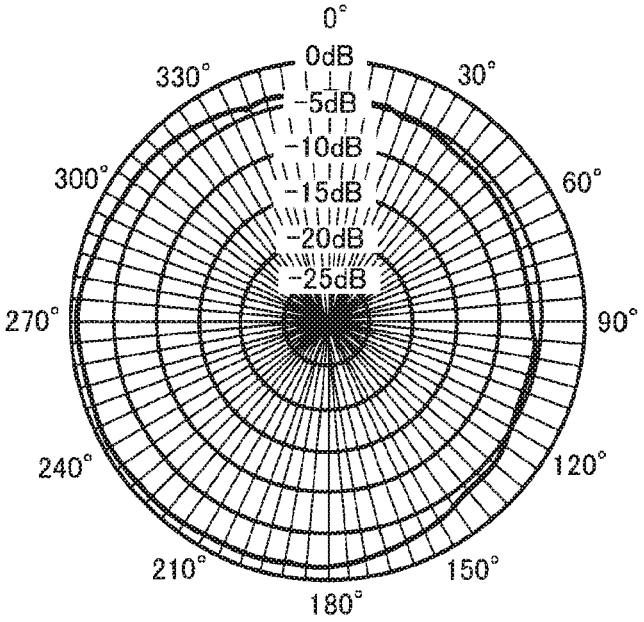
FIG. 12 illustrates the radiation pattern of the patch antenna 110.
Figure 13:
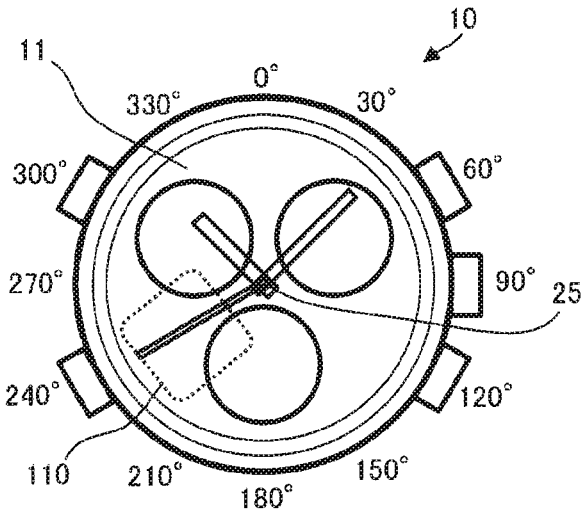
FIG. 13 describes the angles assigned to the electronic timepiece 10.

FIG. 12 illustrates the radiation pattern parallel to the patch antenna 110 when the angles shown in FIG. 13 are applied to the outside circumference of the dial 11 of the electronic timepiece 10. The angles shown in FIG. 13 are applied with 0° at 12:00, and 30°, 60°, 90°, 120°, 150°, 180°, 210°, 240°, 270°, 300°, 330° at 1:00, 2:00, 3:00, 4:00, 5:00, 6:00, 7:00, 8:00, 9:00, 10:00, and 11:00.

In FIG. 13, the range between 6:00 and 11:00 on the dial 11 is the range from 180° to 330° around the center pivot 25.

The patch antenna 110 is between the center pivot 25 and case member 31. The directivity gain of the patch antenna 110 peaks in the direction from the center pivot 25 to the patch antenna 110. In FIG. 12, the directivity of the patch antenna 110 peaks in the direction of 8:00 (240°) on the dial 11 where the center 110*b*4 of the antenna patch 110*b* is located.

Figure 14:
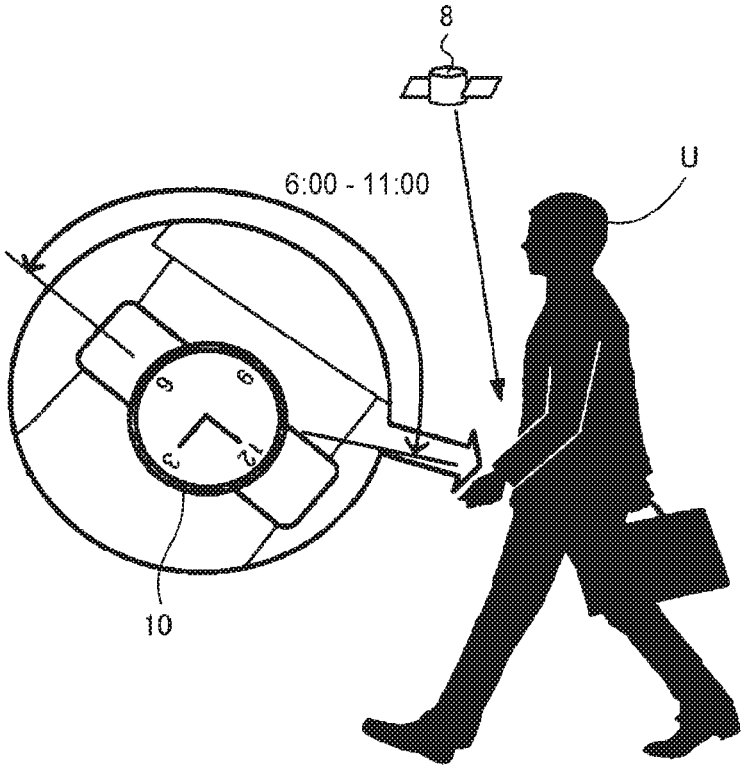
FIG. 14 illustrates an example of the electronic timepiece 10 during signal reception.

As shown in FIG. 14, when the user U wears the electronic timepiece 10 on the left wrist and the left arm is down at the side (referred to herein as the arm-down posture), the range between 6:00 and 11:00 on the dial 11 where the center 110*b*4 of the antenna patch 110*b* is located in plan view is very likely facing in the direction of the GPS satellites 8.

As a result, when the center 110*b*4 of the antenna patch 110*b* is in the range between 6:00 and 11:00 on the dial 11, satellite signals can be received more easily than when the center 110*b*4 of the antenna patch 110*b* is disposed outside the range between 6:00 and 11:00 on the dial 11.

The electronic timepiece 10 therefore has an automatic reception function for automatically receiving satellite signals through the patch antenna 110 when a specific condition is met. This automatic reception function enables the electronic timepiece 10 to determine if a start reception condition has been met and automatically start satellite signal reception if the condition is met, eliminating the need for the user to operate the electronic timepiece 10 to intentionally (manually) start satellite signal reception.

Note that the design of the dial 11 of the electronic timepiece 10 is simplified in FIG. 14 to simplify the following description.

In plan view, the size of the patch antenna 110 is approximately 10×10 mm. For example, in plan view, the substrate 110*a* is substantially square with 11 mm sides, and the antenna patch 110*b* is substantially square with 8-9 mm sides. Note that the size and shape of the substrate 110*a* can be changed desirably according to the size and shape of the antenna patch 110*b*.

The substrate 110*a* is not necessarily rectangular in plan view, and may have portions that are enlarged according to the outside shape of the movement 138 (FIG. 4) of the electronic timepiece 10, or corners truncated to prevent interference with other parts.

The patch antenna 110 is mounted on the first side 100*a* of the circuit board 100. A patch antenna 110 with a ceramic substrate 110*a* is hard and easily chipped. As a result, so that the patch antenna 110 (substrate 110*a*) does not directly contact the main plate 38, sponge or other shock absorber 101 is disposed between the patch antenna 110 (substrate 110*a*) and main plate 38.

To achieve a thin electronic timepiece 10, a through-hole 100*c* is disposed in the circuit board 100 at the part overlapping the storage battery 130 in plan view.

The GPS receiver 122, which functions as a radio communicator, is mounted on the second side 100*b*, which is the opposite side of the circuit board 100 as the first side 100*a*. A GPS-IC (integrated circuit) is used as the GPS receiver 122 in this example.

The GPS receiver 122 is electrically connected to the patch antenna 110 through the circuit board 100. The GPS receiver 122 acquires time information and positioning information for the current location from the satellite signals received by the patch antenna 110.

When the patch antenna 110 is disposed to the first side 100*a*, and the GPS receiver 122 is disposed to the second side 100*b*, of the circuit board 100, it is more difficult for noise from the receiver circuit and power supply circuit (both not shown) of the GPS receiver 122 to affect the patch antenna 110. As a result, the reception sensitivity of the patch antenna 110 is improved when compared with a configuration in which the patch antenna 110 and GPS receiver 122 are both disposed to the first side 100*a* or the second side 100*b*.

A controller 150 is disposed to the first side 100*a* of the circuit board 100. The controller 150 controls the GPS receiver 122 and motors 221 to 226 (see FIG. 15). The controller 150 also controls operation of the patch antenna 110 through the GPS receiver 122.

As shown in FIG. 3, the main plate 38 is disposed on the back cover 34 side of the dial ring 40. A solar panel 135 for solar power generation is disposed on the main plate 38 side of the dial 11.

The solar panel 135 has an ITO or other transparent electrode as the surface electrode that passes light, and an amorphous silicon semiconductor thin film that functions as the power generation layer is formed on a plastic film base. As shown in FIG. 4, the solar panel 135 is connected to the main plate 38 (movement 138) by two coil springs 137. The power generated by the solar panel 135 is used to charge the storage battery 130.

The solar panel 135 has eight solar cells of equal surface area connected in series. Note that the number of solar cells connected in series is not limited to eight, and many be any number capable of producing voltage sufficient to charge the storage battery 130.

Because the GPS satellites 8 transmit satellite signals (radio waves) at a high frequency of 1.5 GHz, unlike the long-wave signals received by radio-controlled timepieces, the satellite signals (radio waves) are attenuated by even the thin transparent electrode of the solar panel 135, and the antenna performance of the patch antenna 110 drops. As a result, a notch 136 is formed in the solar panel 135 (see FIG. 4) so that the solar panel 135 does not overlap the antenna patch 110*b* in plan view. In other words, the solar panel 135 is notched in the part that overlaps the patch antenna 110 in plan view.

A reflective sheet 134 (FIG. 4) is disposed between the dial 11 and solar panel 135. The reflective sheet 134 has a reflection axis and a transmission axis that are parallel to the surface of the reflective sheet 134. The reflection axis and transmission axis intersect each other. The reflective sheet 134 reflects linear polarized components having a vibration plane parallel to the reflection axis, and passes linear polarized components having a vibration plane parallel to the transmission axis. The reflective sheet 134 passes approximately 50% of the light, and reflects approximately 50% of the light. Light reflected by the reflective sheet 134 can make the surface of the dial 11 brighter than when the reflective sheet 134 is not present.

Between the solar panel 135 and main plate 38 are disposed a magnetic shield 104*a* made of pure iron or other high permeability material, and a date indicator bridge 105 (see FIG. 3).

Like the solar panel 135, the magnetic shield 104*a* is shaped so that the magnetic shield 104*a* does not overlap the antenna patch 110*b* in plan view.

High performance magnets are commonly used in modern cell phones, and magnetic resistance to the magnetic field from the cell phone is needed in wristwatches such as the electronic timepiece 10. To divert external magnetic fields and prevent incorrect operation of the motors 221 to 226 (FIG. 15), the magnetic shield 104*a* of the electronic timepiece 10 is disposed to a position not overlapping the motors 221 to 226 in plan view. More particularly, this embodiment of the invention has a second magnetic shield 104*b* in addition magnetic shield 104*a* (FIG. 3, FIG. 4).

The magnetic shield 104*b* is disposed so that the motors 221 to 226 are between it and magnetic shield 104*a*. As a result, compared with when a magnetic shield 104*b* is not present, the magnetic resistance of the motors 221 to 226 is improved.

Each of the motors 221 to 226 has a coil, stator, and rotor. The coil is resistant to the effects of external magnetic fields. As a result, the coil does not necessarily have to be superimposed with the magnetic shields 104*a*, 104*b* in plan view.

Note that a through-hole 104*b*1 is formed in the magnetic shield 104*b* at the part overlapping the storage battery 130 in plan view, and another through-hole 104*b*2 is formed in the part overlapping the GPS receiver 122 in plan view (see FIG. 4).

The date indicator bridge 105 holds the date indicator 106.

The main plate 38 is plastic, and functions as the substrate of the movement 138. The motors 221 to 226, and wheel trains 227, 228, are disposed to the main plate 38.

Figure 15:
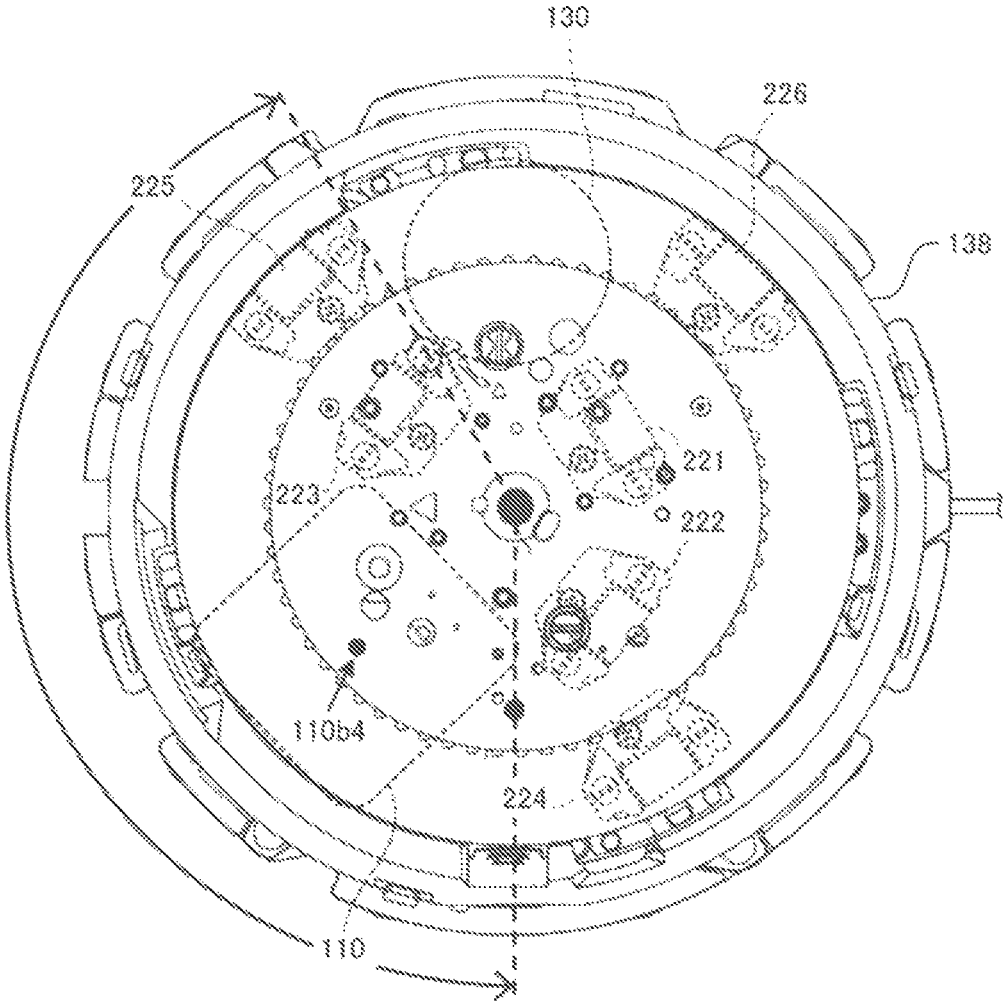
FIG. 15 is a plan view of the movement 138.

FIG. 15 is a plan view of the movement 138, and shows the motors 221 to 226, patch antenna 110, and storage battery 130.

Motor 221 drives hands 22, 23 through wheel train 227. Motor 221 is an example of a first motor. Motor 222 drives hand 21 through a wheel train not shown. Motor 222 is an example of a second motor. Motor 223 drives the date indicator 106 through a wheel train not shown. Motor 224 drives hand 91 through a wheel train not shown. Motor 224 is an example of a second motor. Motor 225 drives hand 81 through a wheel train not shown. Motor 225 is an example of a second motor. Motor 226 drives hand 71 through wheel train 228. Motor 226 is an example of a second motor.

As shown in FIG. 15, the patch antenna 110 does not overlap any of motors 221 to 226, or the storage battery 130, in plan view.

Referring again to FIG. 3, wheel trains 227, 228 and the wheel trains not shown are supported by wheel train bridge 229. The circuit board 100 is also held through the magnetic shield 104*b* by a metal circuit cover 230.

Conductivity from the circuit board 100 to the back cover 34 is established through the magnetic shield 104*b*, circuit cover 230, and a case member conductivity spring 231. The circuit board 100 is also conductive to the case member 31 through another case member conductivity spring 232. Disposing the case member conductivity springs 231, 232 near the patch antenna 110 also effectively increases the ground area.

The electrical configuration of the electronic timepiece 10 is described next.

Figure 16:
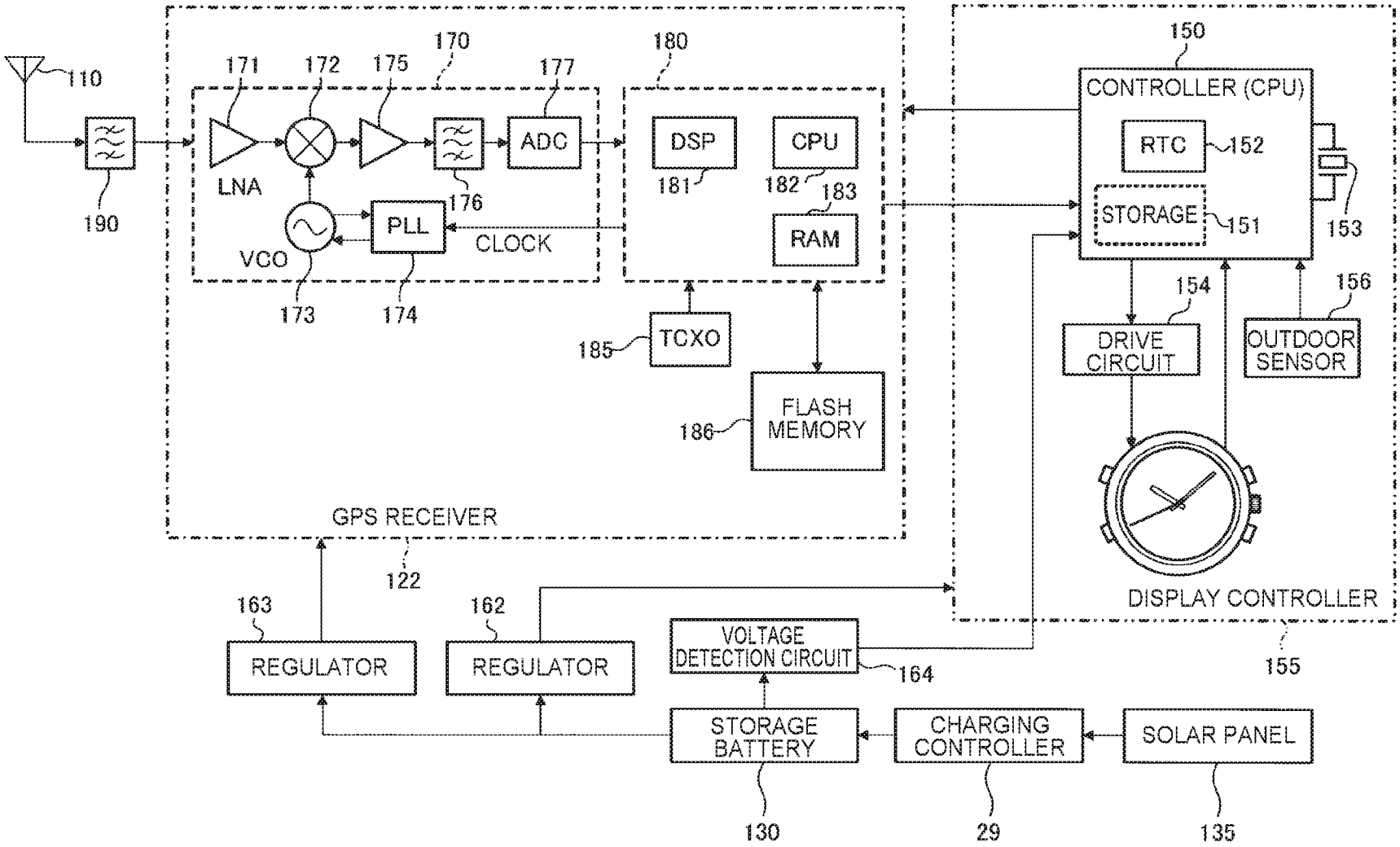
FIG. 16 is a block diagram illustrating the circuit configuration of the electronic timepiece 10.

FIG. 16 is a block diagram illustrating the circuit design of the electronic timepiece 10.

As shown in FIG. 16, the electronic timepiece 10 has a GPS receiver 122, display controller 155, charging controller 29, and solar panel 135. A storage battery 130 is also provided in the electronic timepiece 10.

The GPS receiver 122 is connected to the patch antenna 110. In this example, the GPS receiver 122 is connected to the patch antenna 110 through a SAW filter 190. The GPS receiver 122 is an example of a receiver. The GPS receiver 122 executes processes of receiving satellite signals, locking onto GPS satellites 8, and extracting positioning information. The display controller 155 executes processes including storing internal time information, and correcting the internal time information. The solar panel 135 charges the storage battery 130 through the charging controller 29.

The electronic timepiece 10 also includes regulators 162, 163, and a voltage detection circuit 164.

The storage battery 130 supplies drive power to the display controller 155 through regulator 162, and supplies drive power to the GPS receiver 122 through regulator 163. Note that a regulator 163-1 (not shown in the figure) for supplying drive power to the RF unit 170 described below, and a separate regulator 163-2 (not shown in the figure) for supplying drive power to the baseband unit 180 described below, may be provided instead of regulator 163. In this alternative configuration, the regulator 163-1 may be disposed in the RF unit 170.

The voltage detection circuit 164 detects the voltage of the storage battery 130.

The electronic timepiece 10 also has a patch antenna 110 and SAW (Surface Acoustic Wave) filter 190.

As described above, the patch antenna 110 receives satellite signals transmitted wirelessly from multiple GPS satellites 8. The patch antenna 110 also receives extraneous radio waves other than the satellite signals. As a result, the SAW filter 190 extracts the satellite signals from the signals (radio waves) received by the patch antenna 110. More specifically, the SAW filter 190 functions as a bandpass filter that passes signals in the 1.5 GHz band. The SAW filter 190 may also be incorporated in the GPS receiver 122.

The GPS receiver 122 includes a RF (radio frequency) unit 170, and baseband unit 180. The GPS receiver 122 acquires satellite information including orbit information and GPS time information contained in the navigation message from the satellite signals in the 1.5 GHz band extracted by the SAW filter 190.

The RF unit 170 includes a LNA (Low Noise Amplifier) 171, mixer 172, VCO (Voltage Controlled Oscillator) 173, PLL (Phase Locked Loop) circuit 174, IF amplifier 175, IF (Intermediate Frequency) filter 176, and ADC (analog/digital converter) 177.

The satellite signals extracted by the SAW filter 190 are amplified by the LNA 171. The satellite signals amplified by the LNA 171 are then mixed by the mixer 172 with the clock signal output by the VCO 173, and down-converted to a signal in the intermediate frequency band.

The PLL circuit 174 phase compares the frequency-divided clock signal from the VCO 173 with a reference clock signal, and synchronizes the output clock signal of the VCO 173 with the reference clock signal. As a result, the VCO 173 can output a stabilized clock signal with the frequency precision of the reference clock signal. The intermediate frequency may be a frequency of several MHz, for example.

The signal mixed by the mixer 172 is amplified by the IF amplifier 175. Mixing by the mixer 172 results in a signal in the intermediate frequency band and a high frequency signal of several GHz. As a result, the IF amplifier 175 amplifies both the signal in the intermediate frequency band and the high frequency signal of several GHz. The IF filter 176 passes signals in the intermediate frequency band, and removes (more specifically, attenuates to below a specific level) high frequency signals of several GHz. The intermediate frequency signals that past the IF filter 176 are converted to digital signals by the ADC 177.

The baseband unit 180 includes a DSP (Digital Signal Processor) 181, CPU182, and RAM (Random Access Memory) 183. Connected to the baseband unit 180 are a TCXO (Temperature Compensated Crystal Oscillator) 185, and flash memory 186.

The TCXO 185 generates a reference clock signal of a constant frequency regardless of temperature.

Time information (the time difference to UTC) is stored in the flash memory 186 relationally to positioning information (latitude and longitude, for example). A program defining the operation of the baseband unit 180 is also stored in flash memory 186.

The CPU 182 controls the baseband unit 180, and the GPS receiver 122, by reading and running a program stored in flash memory 186. Note that EEPROM (Electrically Erasable Programmable Read Only Memory) may be used instead of flash memory 186.

The baseband unit 180 demodulates the baseband signal from the digital signals (intermediate frequency signals) converted by the ADC 177 of the RF unit 170.

During the satellite search described below, the baseband unit 180 generates a local code of the same pattern as each C/A code, and determines the correlation between the local code and the C/A code contained in the baseband signal. The baseband unit 180 adjusts the timing for generating the local code to maximize the correlation to the local code, and when the correlation equals or exceeds a threshold value, determines that local code is synchronized with the GPS satellite 8 (that is, determines a GPS satellite 8 was locked onto). The GPS system uses CDMA (Code Division Multiple Access), a method enabling all GPS satellites 8 to transmit satellite signals at the same frequency using different C/A codes. GPS satellites 8 that can be lock onto can therefore be found by evaluating the C/A code contained in each received satellite signal.

To acquire satellite information from the locked GPS satellites 8, the baseband unit 180 mixes the baseband signal with the local code of the same pattern as the C/A code of that GPS satellite 8. The navigation message containing the satellite information of the locked GPS satellite 8 is then demodulated from the mixed signal. The baseband unit 180 then detects the TLM word (preamble data) from each subframe in the navigation message, and acquires the satellite information, including orbit information and GPS time information, contained in each subframe. The baseband unit 180 also stores the satellite information in RAM 183. The GPS time information includes week number data (WN) and Z count data, but if the week number data has already been received, acquiring only the Z count data is possible.

The week number data is information indicating the week in which the current GPS time information is included. The starting point of the GPS time information is 1980.1.6.00.00.00 UTC, and the week beginning at this time is week number 0. The week number is updated each week.

The Z count data expresses the time elapsed since 00:00 each Sunday, and returns to 0 at 00:00 Sunday the next week. The Z count therefore expresses the number of seconds that have past each week since the beginning of that week.

An example in which the Z count is used as the GPS time information is described below.

The baseband unit 180 has a time information acquisition mode and a positioning information acquisition mode.

In the time information acquisition mode, the baseband unit 180 calculates the time based on the GPS time information (Z count data).

In the positioning information acquisition mode, the baseband unit 180 calculates the location (position) based on the GPS time information and orbit information, and acquires the current position (the latitude and longitude of the location of the electronic timepiece 10 during reception). The baseband unit 180 then references the flash memory 186, and acquires the time difference information related to the coordinates (such as latitude and longitude) of the electronic timepiece 10 defined by the positioning information.

Operation of the baseband unit 180 is synchronized to the reference clock signal output by the TCXO 185.

The display controller 155 includes a controller 150, drive circuit 154, crystal oscillator 153, and outdoor sensor 156.

The controller 150 has storage 151 and a RTC 152, and controls other parts of the timepiece. The controller 150 may be configured with a CPU, for example.

The controller 150 sends control signals to the GPS receiver 122, and controls the reception operation of the GPS receiver 122.

Based on the detection result from the voltage detection circuit 164, the controller 150 controls operation of regulator 162 and regulator 163.

The controller 150 also controls, through the drive circuit 154, hands 21, 22, 23, 71, 81, and 91, and the date indicator 106. The drive circuit 154 includes a drive circuit for the second hand 21; a drive circuit for hands 22, 23; a drive circuit for hand 71; a drive circuit for hand 81; a drive circuit for hand 91; and a drive circuit for the date indicator 106.

Information (such as the Z count data and time difference data) generated by the baseband unit 180 is stored in the storage 151. The controller 150 corrects the internal time information based on data generated by the baseband unit 180. The internal time information is information about the internal time kept by the electronic timepiece 10. The internal time information is updated based on a reference clock signal, which is generated by the crystal oscillator 153 and counted by the constantly driven RTC 152. The internal time information can therefore be updated and hands 22, 23, 81 driven continuously even when the power supply to the GPS receiver 122 is stopped.

The outdoor sensor 156 is an example of an outdoor detector. The outdoor sensor 156 detects whether or not the electronic timepiece 10 is outdoors. An illuminance sensor is used as the outdoor sensor 156 in this example. When the ambient light (illuminance) exceeds a specific threshold, the outdoor sensor 156 (illuminance sensor) determines the electronic timepiece 10 is outdoors.

When in the time information acquisition mode and a specific condition is met, the controller 150 operates the GPS receiver 122, corrects the internal time information based on the GPS time information (Z count), and stores the corrected internal time in the storage 151. More specifically, the internal time information is adjusted to the time acquired by adding the UTC offset to the acquired GPS time.

This embodiment of the invention uses two specific conditions, condition A and condition B. Condition A is met when the outdoor sensor 156 determines the electronic timepiece 10 is outdoors. Condition B is met when the internal time reaches a specific time.

Satellite signals are preferably received when outdoors, and because the time when outdoors varies according to the user U, the specific time for starting satellite signal reception is preferably set for the specific user U. As a result, the electronic timepiece 10 stores the set time set by operation of the crown 50, for example, in the storage 151 as the specific time for satellite signal reception.

If a specific condition (condition A or condition B) is met in the positioning information acquisition mode, the controller 150 operates the GPS receiver 122 and calculates the current position based on the received satellite signals. The controller 150 then corrects and stores the internal time information in the storage 151 based on the time difference corresponding to the calculated location.

Operation is described next.

Figure 17:
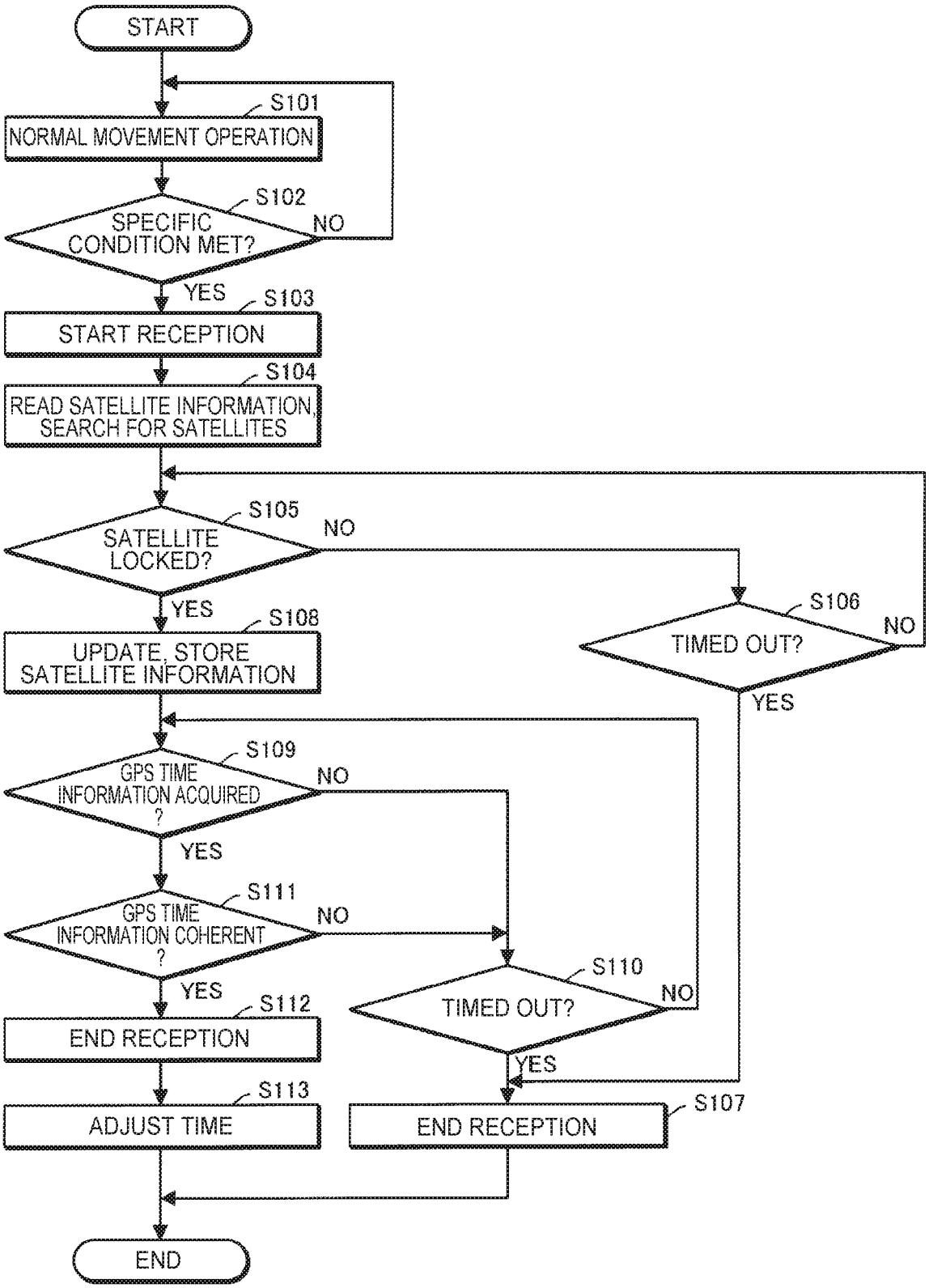
FIG. 17 is a flow chart describing operation in the time information acquisition mode.

FIG. 17 is a flow chart describing operation when in the time information acquisition mode.

The controller 150 controls the drive circuit 154 to drive the movement normally so that the hands 22, 23, 24 display the current time indicated by the internal time information (step S101).

Next, the controller 150 determines if a specific (condition A or condition B) is met (step S102).

If condition A or condition B is met, the controller 150 outputs a first control signal instructing the GPS receiver 122 to drive the patch antenna 110 in the automatic reception mode. When the first control signal is received, the GPS receiver 122 drives the patch antenna 110 and starts satellite signal reception (step S103).

Next, the baseband unit 180 reads from RAM 183 the satellite information of the GPS satellites 8 that were locked onto the last time satellite signals were received, and starts searching for the GPS satellites 8 that were last locked onto (from which satellite signals were received) (step S104).

The satellite signals received by the patch antenna 110 in conjunction with the start of satellite signal reception are extracted by the SAW filter 190 and supplied to the RF unit 170. The RF unit 170 converts the satellite signals to intermediate frequency digital signals, and outputs to the baseband unit 180.

The baseband unit 180, using the intermediate frequency digital signals received from the RF unit 170, determines if a GPS satellite 8 was locked onto (step S105).

If a GPS satellite 8 cannot be acquired (step S105: NO), the baseband unit 180 if the time elapsed from when reception started has reached a specified timeout time (such as 15 seconds) (step S106).

If the timeout time has passed and operation times out (step 106: YES), the baseband unit 180 ends reception by the GPS receiver 122 (step S107). The process shown in FIG. 15 then executes again.

However, if operation has not timed out in step S106 (step S106: NO), the baseband unit 180 returns to step S105.

When a GPS satellite 8 is locked in step S105 (step S105: YES), the baseband unit 180 receives through the RF unit 170 the satellite information contained in the satellite signals from the GPS satellite 8 that was locked. The baseband unit 180 then updates the satellite information stored in RAM 183 to the new satellite information that was received (step S108).

Next, the baseband unit 180 determines whether or not the GPS time information (Z count) contained in the satellite information was acquired (step S109).

If the GPS time information cannot be acquired (step S109: NO), the baseband unit 180 determines if a specific timeout time (such as 60 seconds) has past (step S110).

If in step S110 the timeout time has passed and operation times out (step 110: YES), the baseband unit 180 ends reception by the GPS receiver 122 (step S107). The process shown in FIG. 17 then executes again.

However, if operation has not timed out in step S110 (step S110: NO), the baseband unit 180 returns to step S109.

If in step S109 the GPS time information (Z count) was acquired (step S109: YES), the baseband unit 180 determines the coherence of the GPS time information (step S111). For example, the baseband unit 180 may read the internal time information from the controller 150, and compare the internal time information with the GPS time information (Z count) to determine the coherence of the GPS time information.

If the GPS time information is determined in step S111 to lack coherence (step S111: NO), the baseband unit 180 goes to step S110.

However, if the GPS time information is determined in step S111 to be coherent (step S111: YES), the baseband unit 180 ends reception (step S112).

When step S112 ends, the baseband unit 180 outputs the acquired GPS time information (Z count) to the controller 150. Using the GPS time information (Z count) received from the baseband unit 180, the controller 150 corrects the internal time information kept by the RTC 152 (step S113).

When the internal time information is corrected, the controller 150 adjusts the time indicated by the hands 22, 23, 24 through the drive circuit 154 based on the corrected internal time information. The process shown in FIG. 17 then executes again.

Figure 18:
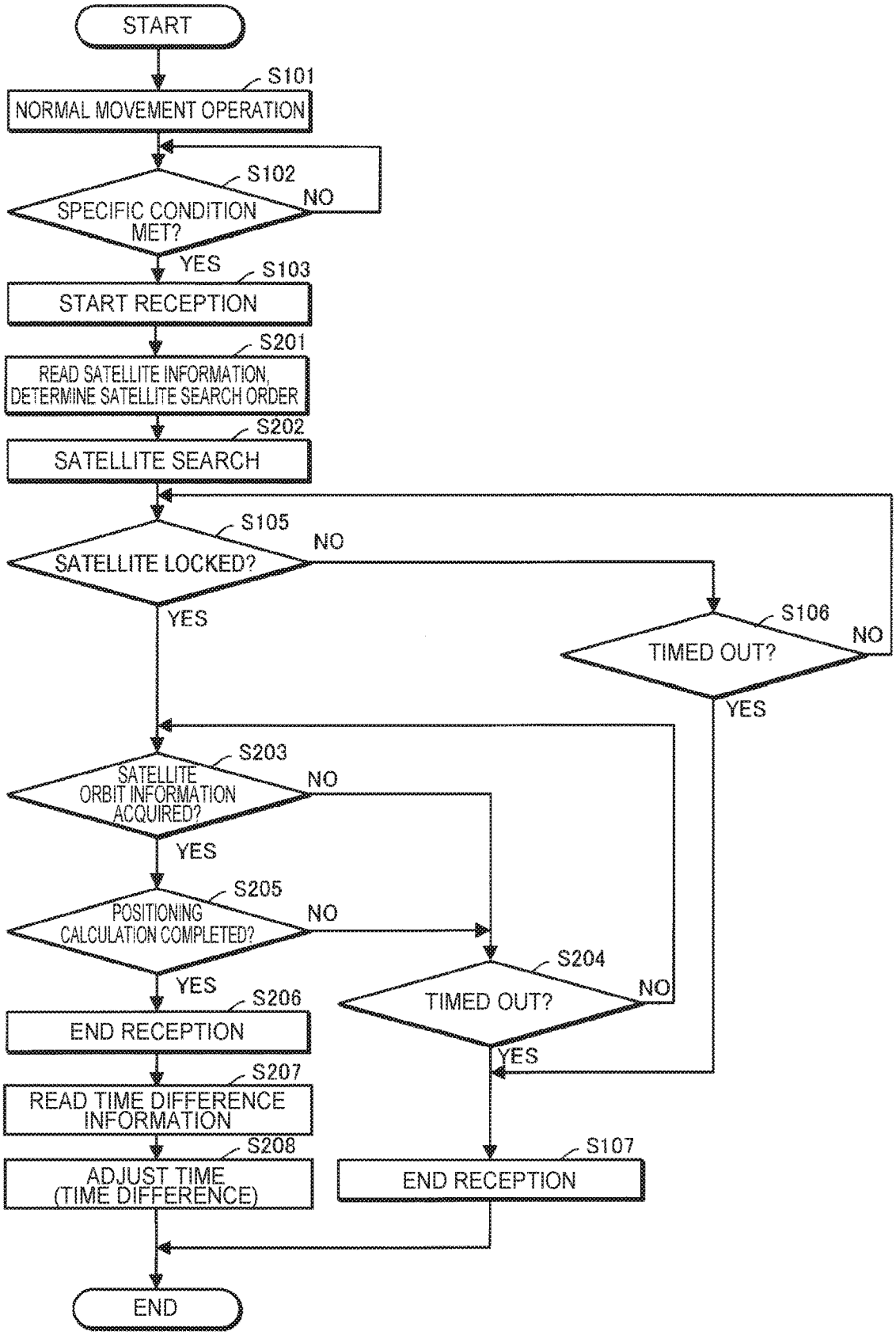
FIG. 18 is a flow chart describing operation in the positioning information acquisition mode.

FIG. 18 is a flow chart describing operation when in the positioning information acquisition mode. Steps that are the same as in the process in FIG. 17 are identified by the same step numbers in FIG. 18. Operation in the positioning information acquisition mode is described below focusing on the differences with the process shown in FIG. 17.

When the GPS receiver 122 starts satellite signal reception (step S103), the baseband unit 180 reads from RAM 183 the satellite information of the GPS satellites 8 that were locked onto the last time satellite signals were received, and sets the GPS satellites 8 that were previously locked at the beginning of the search precedence order, which defines the order in which to search for GPS satellites 8.

GPS satellites 8 circle the Earth in approximately 12 hours, and the specific orbit changes in an approximately 24 hour cycle. As a result, the baseband unit 180 can roughly determine the GPS satellites 8 that can be locked onto at the current time based on the time when reception starts. The baseband unit 180 determines the GPS satellite 8 search order by setting the GPS satellites 8 determined to be lockable based on the time reception starts from the beginning of the search order defining the precedence for locating satellites (step S201). At least four GPS satellites 8 are set in the search order.

Next, the baseband unit 180 starts searching for the GPS satellites 8 from the beginning of the search order (step S202).

Next, the baseband unit 180 determines if the number of GPS satellites 8 required to calculate the position (at least three, normally four) have been found and locked onto (step S105).

If at least the specific number of GPS satellites 8 was locked onto in step S105 (step S105: YES), the baseband unit 180 determines if orbit information was successfully acquired from each of the GPS satellites 8 (step S203). More specifically, the baseband unit 180 determines if orbit information and GPS time information could be acquired. For simplicity, this decision is described below as determining if the orbit information could be acquired.

If orbit information cannot be acquired from each of the locked GPS satellites 8 (step S203: NO), the baseband unit 180 determines if the timeout time for calculating the position (for example, 120 seconds) has past (step S204).

If in step S204 the timeout time has past (step S204: YES), the baseband unit 180 ends reception by the GPS receiver 122 (step S107). The process shown in FIG. 18 then executes again.

If orbit information was acquired from each of the locked GPS satellites 8 (step S203: YES), the baseband unit 180 calculates the current position using the orbit information (and GPS time information), and determines if the positioning calculation was completed (step S205).

If the baseband unit 180 has not completed the positioning calculation (step S205: NO), it goes to step S204.

If the baseband unit 180 has completed the positioning calculation (step S205: YES), the baseband unit 180 ends reception by the GPS receiver 122 (step S206).

The baseband unit 180 then reads, from flash memory 186, time difference information corresponding to the positioning information (latitude and longitude) calculated in the positioning calculation, and outputs to the controller 150 (step S207).

The controller 150 then corrects the internal time information using the time difference information output from the baseband unit 180 (step S208).

When the internal time information is corrected, the controller 150 adjusts the time indicated by the hands 22, 23, 24 through the drive circuit 154 based on the corrected internal time information. The process shown in FIG. 18 then executes again.

In this embodiment of the invention, the center 110*b*4 of the antenna patch 110*b* is disposed in the range between 6:00 and 11:00 on the dial 11, and when a specific condition is met, the controller 150 automatically operates the patch antenna 110.

As a result, compared with a configuration in which the center 110*b*4 of the antenna patch 110*b* is disposed outside the range between 6:00 and 11:00 on the dial 11, when the user U is outside in the arm-down posture, the direction of greatest patch antenna 110 gain can more easily align with the direction in which the GPS satellites 8 are present. Satellite signals can therefore be received more easily when satellite signals are received automatically.

Because one of the specific conditions is condition B, which tests if the internal time kept by the RTC 152 has reached a specific time, if a time when the user U is more likely to be outside is set at the specific time, the possibility that satellite signals can be received automatically increases.

Because one of the specific conditions is condition A, which tests if the outdoor sensor 156 has detected that the electronic timepiece 10 is outdoors, satellite signals can be received automatically in situations in which the possibility of receiving satellite signals is high, that is, when the electronic timepiece 10 is outdoors.

Because the patch antenna 110 is disposed to a position not overlapping the motors 221 to 226 in plan view, degradation of the reception performance of the patch antenna 110 by the effects of metal parts in the motors 221 to 226 can be suppressed. The electronic timepiece 10 can also be made thinner.

Because the solar panel 135 is notched, forming a space, in the part where the solar panel 135 would overlap the patch antenna 110 in plan view, degradation of the reception performance of the patch antenna 110 by the effects of metal parts in the solar panel 135 can also be suppressed.

Variations

The invention is not limited to the embodiment described above, and can be varied in many ways as described below. One or more desirable variations described below may also be selectively combined as desired.

Variation 1

All of the antenna patch 110*b* may be disposed the range between 6:00 and 11:00 on the dial 11. This configuration makes satellite signals reception even easier when satellite signal reception executes automatically.

Variation 2

Only condition A or condition B may be used as the specific condition.

Variation 3

The outdoor sensor 156 is not limited to an illuminance (light) sensor, and other desirable configurations may be used. For example, a UV sensor, or a detection unit that uses an accelerometer to determine if the user U is walking for a specific time or longer, may be used as the outdoor sensor 156.

Furthermore, because the solar panel 135 has a sunlight detection capability, the solar panel 135 may also be used as the outdoor sensor 156. In this case, the configuration of the timepiece can be simplified because a dedicated outdoor sensor 156 can be omitted.

Variation 4

Figure 19:
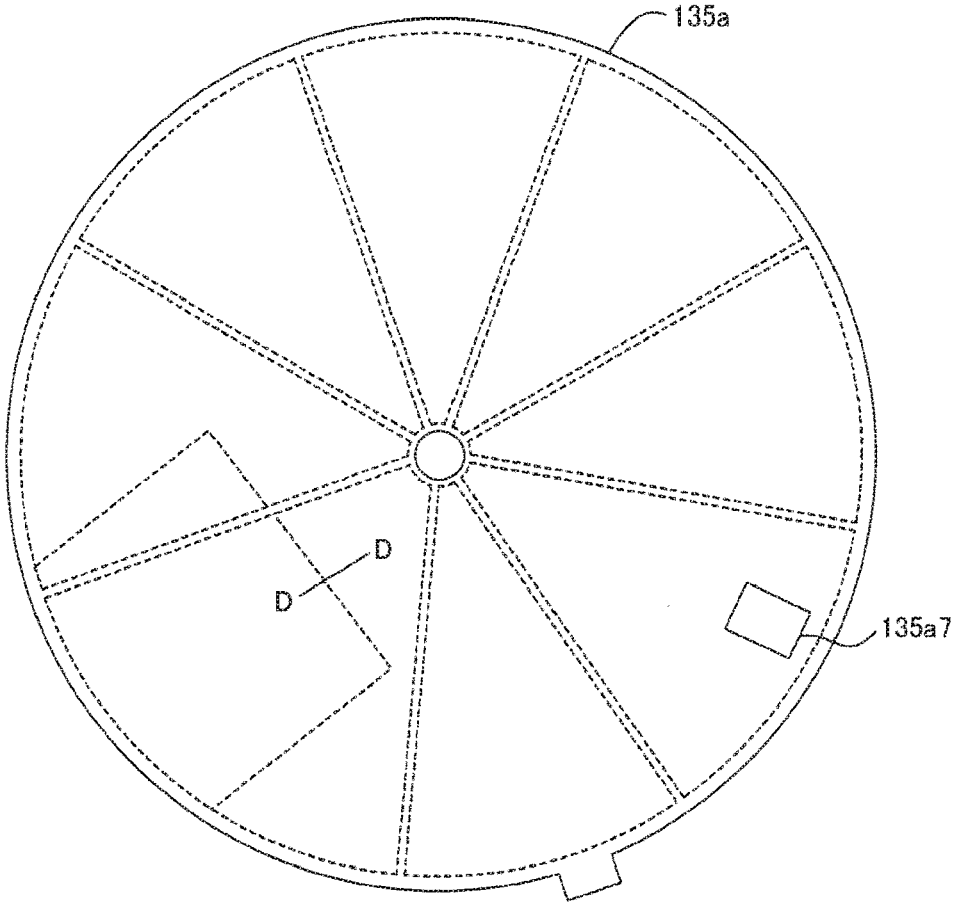
FIG. 19 shows another example of a solar panel.
Figure 20:
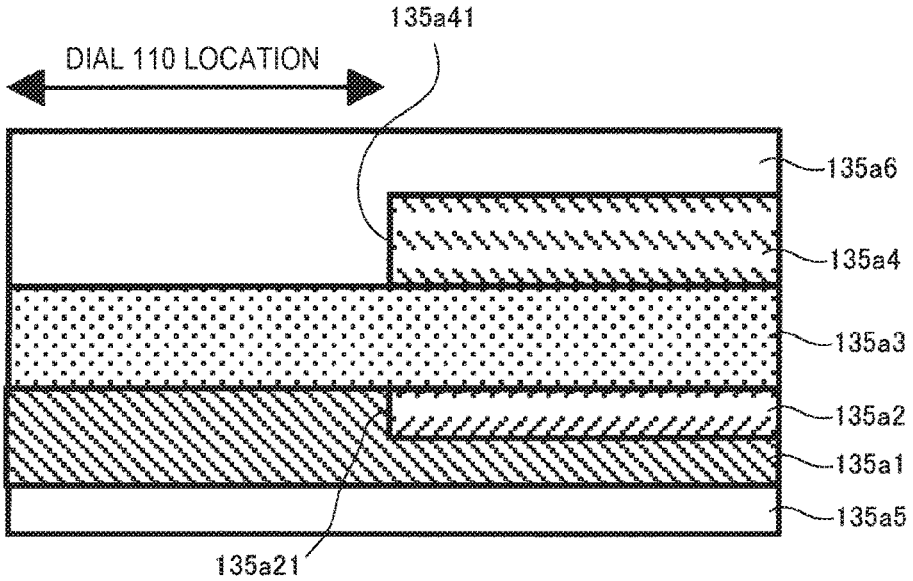
FIG. 20 is a partial section view of the solar panel shown in FIG. 19.

A solar panel 135*a* such as shown in FIG. 19 may be used instead of the solar panel 135 described above. FIG. 20 is a partial section view of the solar panel 135*a* through line D-D in FIG. 19.

The solar panel 135*a* in this variation has a calendar window 135*a*7, and as shown in FIG. 20, has an aluminum electrode 135*a*2 disposed to the dial 11 side surface of a resin substrate 135*a*1. On the dial 11 side surface of the aluminum electrode 135*a*2 is disposed an amorphous silicon layer 135*a*3 that functions as the power generating layer. On the dial 11 side surface of the amorphous silicon layer 135*a*3 is a transparent electrode 135*a*4 of ITO, for example. On the movement 138 side surface of the solar panel 135*a* is disposed a dielectric back protective layer 135*a*5, and a dielectric front protective layer 135*a*6 is disposed on the dial 11 side surface of the notch 135*a*.

A notch 135*a*21 is formed in the aluminum electrode 135*a*2 in the part overlapping the patch antenna 110 in plan view. A notch 135*a*41 is also formed in the transparent electrode 135*a*4 in the part overlapping the patch antenna 110 in plan view.

As a result, degradation of the reception performance of the patch antenna 110 due to the aluminum electrode 135*a*2 and transparent electrode 135*a*4 can be suppressed.

The protective layer 135*a*6, amorphous silicon layer 135*a*3, substrate 135*a*1, and protective layer 135*a*5 have areas that overlap the patch antenna 110 in plan view, or in other words, also overlap the dial 11 in plan view.

As a result, compared with using a solar panel 135 having a notch 135*a*, differences in color between parts overlapping and parts not overlapping the aluminum electrode 135*a*2 and transparent electrode 135*a*4 can be reduced.

Variation 5

Figure 21:
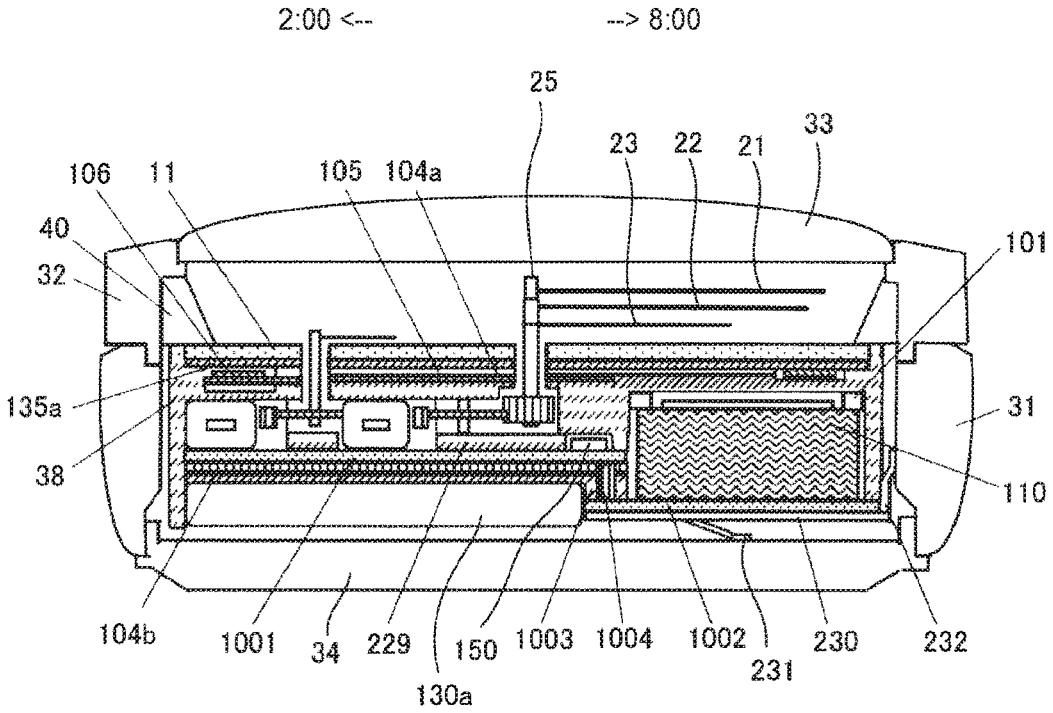
FIG. 21 shows a variation of the electronic timepiece 10.

FIG. 21 shows an example of an electronic timepiece having circuit boards 1001 and 1002 instead of circuit board 100, and using the solar panel 135*a* (see FIG. 19) described in variation 4 above instead of solar panel 135. By using solar panel 135*a*, color variations in the dial 11 can be suppressed, and a drop in the reception performance of the patch antenna 110 an be suppressed.

Figure 22:
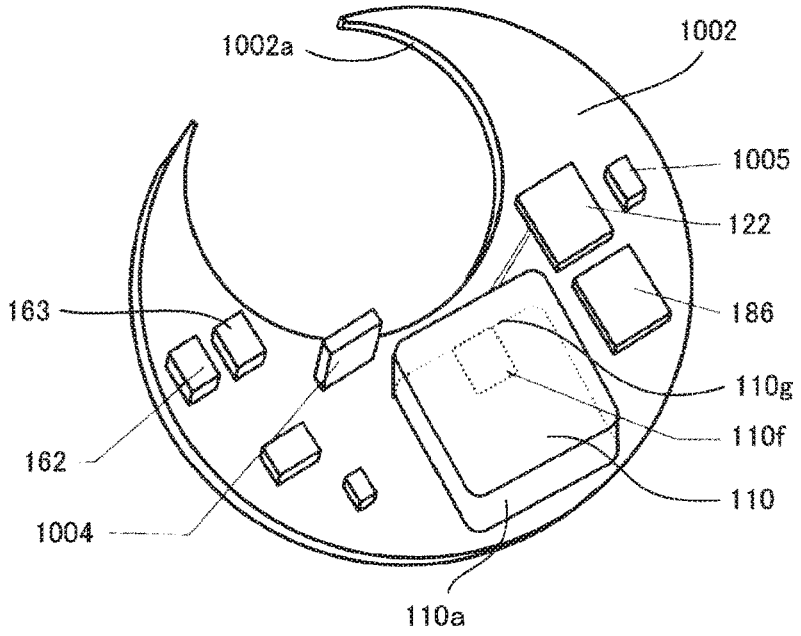
FIG. 22 shows an example of the circuit board 1002.

FIG. 22 shows an example of circuit board 1002. A through-hole 1002*a* conforming to the shape of the storage battery 130*a* is disposed in circuit board 1002. The through-hole 1002*a* is an example of a notch. The storage battery 130*a* is disposed in the through-hole 1002*a*. Ignoring the through-hole 1002*a*, the circuit board 1002 is round in plan view.

A standard time signal receiver 1005 that receives standard time signals indicating the time is provided in addition to the GPS receiver 122 on the circuit board 1002. As a result, the electronic timepiece shown in FIG. 21 can receive a standard time signal and correct the kept time of the internal time when signals transmitted by the GPS satellites 8 cannot be received.

For simplicity, the antenna patch 110*b* of the patch antenna 110 is not shown in FIG. 22. The antenna patch 110*b* and feed electrode 110*f* are also electromagnetically coupled in the configuration shown in FIG. 22. As a result, the thickness of the patch antenna 110, and more specifically the thickness of the movement 138, can be reduced.

A spacer 1003 is disposed between circuit board 1001 and circuit board 1002, thereby maintaining a gap between circuit board 1001 and circuit board 1002. Circuit board 1001 and circuit board 1002 are electrically connected by a connector 1004.

The controller 150 and motors 221 to 226 are disposed on the dial 11 side of the circuit board 1001, and the storage battery 130*a* is disposed on the back cover 34 side. The patch antenna 110 and GPS receiver 122 (see FIG. 22) are disposed to the dial 11 side of circuit board 1002.

On circuit board 1002, the feed electrode 110*f* connects to the side 110*g* of the multiple sides of the substrate 110*a* that is closest to the center of the circuit board 1002. As a result, the symmetry (alignment of the feed point with the center of the ground plane) of the patch antenna 110 including the circuit board 1002 as the ground plane improves, and circularly polarized waves transmitted from the GPS satellites 8 can be efficiently received.

Because six motors, motors 221 to 226, are used in the example shown in FIG. 21, 12 motor leads are required. As a result, when the motors 221 to 226 are disposed to the circuit board 1001, and the controller 150 is disposed to the circuit board 1002, the size of the connector 1004 that connects the circuit board 1001 and circuit board 1002 is increased because twelve motor leads pass therethrough. The problem of the increased size of the connector 1004 occurs not only when there are six motors, but also when the motors and controller 150 are disposed to different circuit boards.

When multiple circuit boards are used, if the controller 150 is disposed to the circuit board on which a motor (coil) is disposed as described in variation 5, increasing the size of the connector can be suppressed, the motor leads can be shortened, and motor performance can be more easily assured.

Circuit board 1001 is disposed closer to the dial 11 than circuit board 1002. As a result, a storage battery 130*a* that is larger (such as a storage battery 130*a* with a diameter of 20 mm or 16 mm) than the storage battery 130 used in a electronic timepiece 10 using circuit board 100 described above can be used. A electronic timepiece 10 having circuit board 1001 and circuit board 1002 can therefore be desirably used in an electronic timepiece having a high power consumption tracking function (a function for continuously acquiring positioning information).

Variation 6

Figure 23:
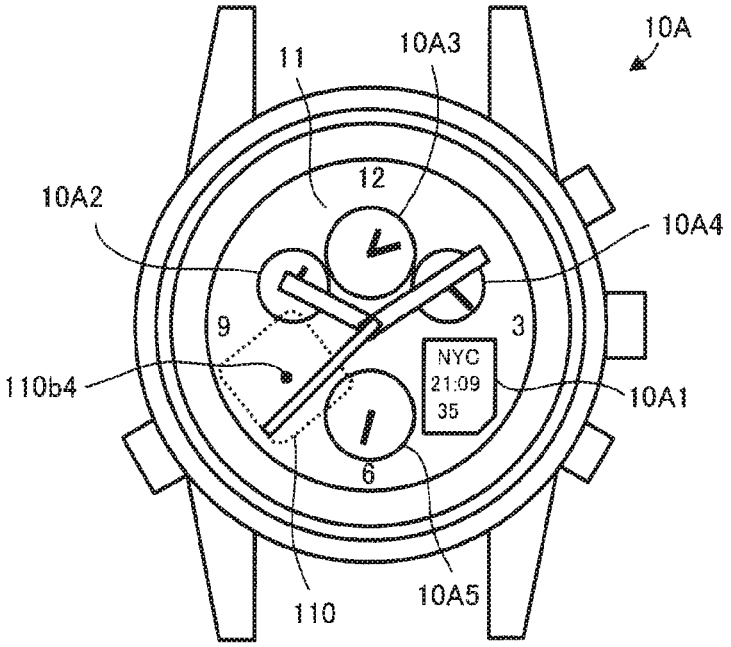
FIG. 23 illustrates an electronic timepiece 10A according to a another embodiment of the invention.

FIG. 23 shows an example of a electronic timepiece 10A having an LCD digital display 10A1 configured with the center 110*b*4 of the antenna patch 110*b* disposed in the range between 6:00 and 11:00 on the dial 11. In FIG. 23, the center 110*b*4 of the antenna patch 110*b* is disposed at 8:00. In plan view, the patch antenna 110 does not overlap the digital display 10A1.

Like the electronic timepiece 10 shown in FIG. 2, this electronic timepiece 10A has a GPS receiver 122 and display controller 155.

In addition to digital display 10A1, the electronic timepiece 10A also has a battery voltage indicator 10A2, a second time display 10A3, a chronograph display 10A4, and a mode indicator 10A5. The electronic timepiece 10A has at least a time display mode, location display mode, and chronograph mode.

The electronic timepiece 10A also has a world time function for selectively displaying the time in multiple cities (locations). In FIG. 23, the digital display 10A1 that digitally displays information shows the time in NYC (New York City) as 21:9:35. When in the location display mode, the digital display 10A1 displays the location (latitude and longitude) calculated using satellite signals.

The electronic timepiece 10A also has an orientation sensor, and provides a navigation function indicating the direction to a destination based on the result from the orientation sensor and the GPS positioning information. In this event, the digital display 10A1 may also indicate the direction to the destination.

The battery voltage indicator 10A2 indicates the voltage of the storage battery 130.

The second time display 10A3 can display the time in a location different from the location corresponding to the time indicated on the dial 11.

The chronograph display 10A4 indicates the chronograph (stop watch) time when in the chronograph mode.

The mode indicator 10A5 indicates the current operating mode.

Variation 7

When a electronic timepiece 10 capable of holding a large storage battery 130*a* such as shown in FIG. 21 has a tracking function, a digital display capable of displaying more information is desirable.

Figure 24:
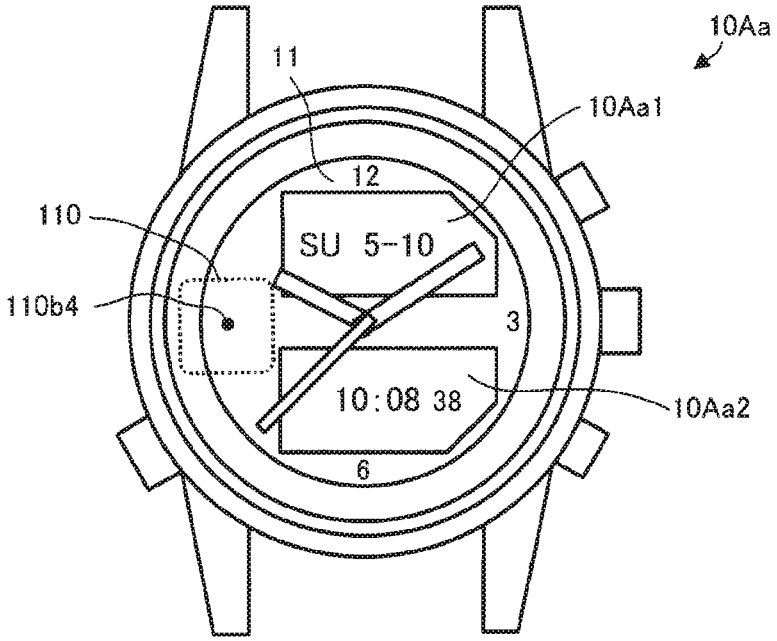
FIG. 24 illustrates an electronic timepiece 10Aa according to a another embodiment of the invention.

FIG. 24 shows an example of a electronic timepiece 10Aa having display units 10Aa1 and 10Aa2 for digitally displaying information. In this electronic timepiece 10Aa, the center 110*b*4 of the antenna patch 110*b* is at 9:00. Like the electronic timepiece 10 shown in FIG. 2, electronic timepiece 10Aa has a GPS receiver 122 and display controller 155. The electronic timepiece 10Aa has more digital display units than the electronic timepiece 10A shown in FIG. 23, and is better suited to outdoor applications because it can digitally display more information.

Display unit 10Aa1 and 10Aa2 are LCD panels, EPD (electrophoretic display) panels, or OLED (electroluminescence) panels. As a result, display unit 10Aa1 and 10Aa2 each have transparent electrodes (ITO). In plan view, the patch antenna 110 does not overlap either display unit 10Aa1 or 10Aa2. As a result, degradation of the reception performance of the patch antenna 110 by the transparent electrodes of first side 100*a* and 10Aa2 can be suppressed.

Variation 8

Figure 25:
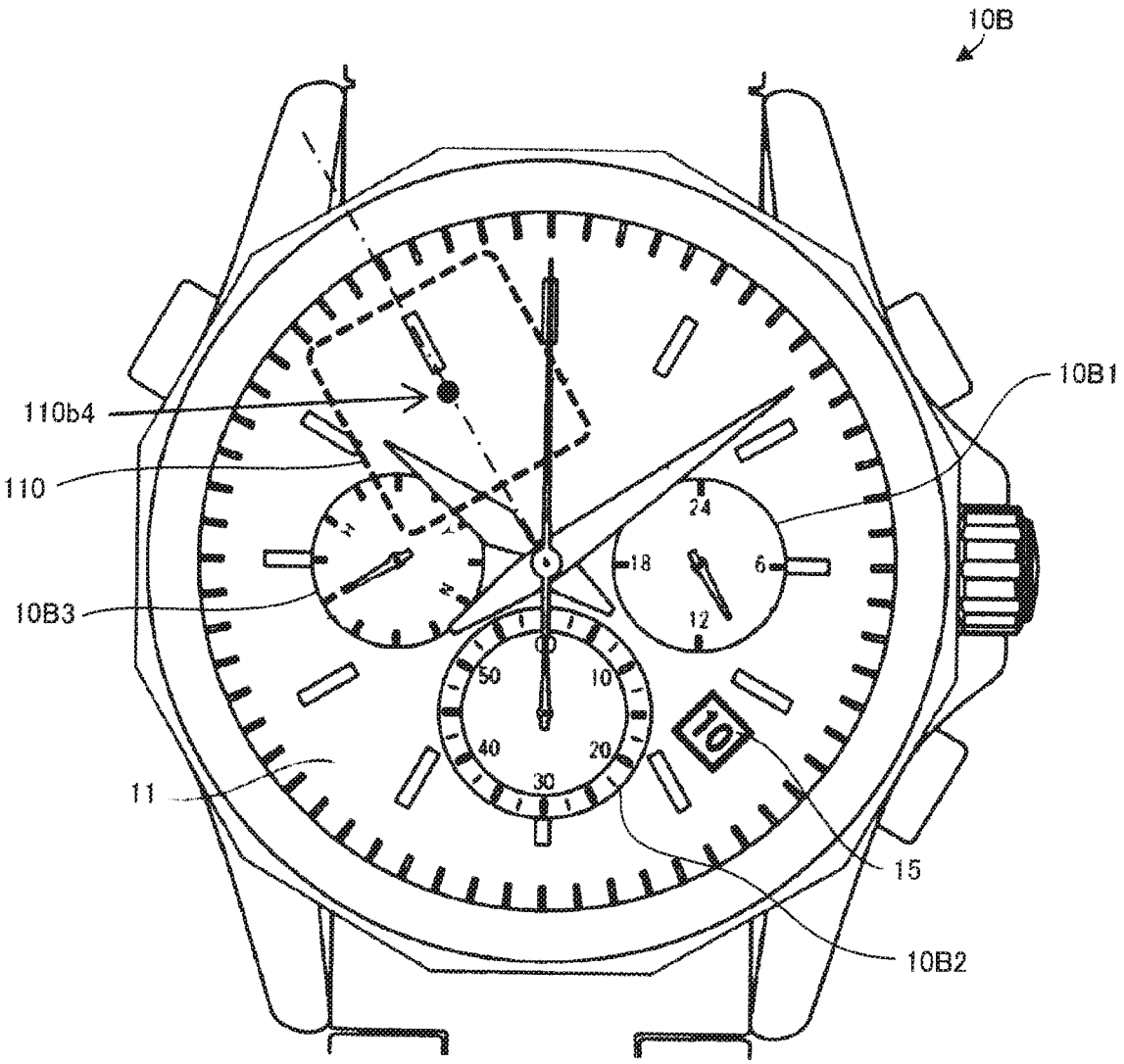
FIG. 25 illustrates an electronic timepiece 10B according to a another embodiment of the invention.

FIG. 25 illustrates an electronic timepiece 10B having the center 110*b*4 of the antenna patch 110*b* of the patch antenna 110 at 11:00 on the dial 11.

This electronic timepiece 10B has an orientation sensor (not shown in the figure), a second time display 10B1, chronograph display 10B2, and orientation indicator 10B3. The second time display 10B1 can display the time in a location different from the location corresponding to the time indicated on the dial 11.

The chronograph display 10B2 indicates the chronograph (stop watch) time when in the chronograph mode.

The orientation indicator 10B3 indicates the direction according to the output of the orientation sensor.

In this embodiment, the center 110*b*4 of the antenna patch 110*b* is also located in the range between 6:00 and 11:00 on the dial 11. As a result, compared with a configuration in which the center 110*b*4 of the antenna patch 110*b* is disposed outside the range between 6:00 and 11:00 on the dial 11, when the user U is outside in the arm-down posture, the direction of greatest patch antenna 110 gain can more easily align with the direction in which the GPS satellites 8 are present. Satellite signals can therefore be received more easily when satellite signals are received automatically.

Variation 9

The shape of the feed electrode 110*f* is not limited to rectangular, and may be changed as desired.

Variation 10

An antenna and Bluetooth (R) or other near-field communication device may be added to the embodiment or variations described above.

In this case, the near-field communication device does not continuously connect to an external device, but connects to and exchanges data with the external device as required. For example, the near-field communication device may receive time difference information from an external device, store the received time difference information in storage 151, or overwrite the time difference information stored in storage 151 with the received time difference information.

Note that information the near-field communication device receives from an external device is not limited to time difference information, and may change as needed. For example, the near-field communication device may receive GPS assist data, such as GPS satellite orbit information that effectively shortens the GPS reception time, or update data such as leap second information, from an external device, and store the received information in storage 151.

Variation 11

GPS satellites are used as examples of positioning information satellites above, but positioning information satellites are not limited to GPS satellites. For example, satellites used in Global Navigation Satellite Systems (GNSS) such as Galileo (EU) and GLONASS (Russia) may be used as the positioning information satellites. Geostationary satellites such as used in satellite-based augmentation systems (SBAS), and quasi-zenith satellites (such as Michibiki) used in radio navigation satellite systems (RNSS) that can only search in specific regions, can also be used.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosures of Japanese Patent Application Nos. 2016-218020, filed Nov. 8, 2016 and 2017-096822, filed May 15, 2017 are expressly incorporated by reference herein.

What is claimed is:

1. An electronic timepiece comprising:

a time display including a dial and displaying time by the position indicated by a first hand;

a battery;

a circuit board including a notch defined by a shape of the battery, the battery being disposed in the notch;

a circularly polarized patch antenna that receives a satellite signal and includes:

a dielectric substrate having a first surface closest to the dial and a second surface closest to the circuit board, the second surface having a plurality of sides connecting the second surface with the first surface, a radiating electrode disposed on the first surface, a ground electrode disposed on the second surface and electrically connected to the circuit board, the ground electrode being configured to ground the patch antenna, and a feed electrode disposed on the second surface and contacting and aligning with a side of the plurality of sides of the dielectric substrate that is closest to a center of the circuit board in plan view from the dial side of the time display, the feed electrode being electromagnetically coupled to the radiating electrode without the use of a feed pin, and the feed electrode being separated from the ground electrode on the second surface by a gap; and a receiver connected to the circularly polarized patch antenna.

2. The electronic timepiece described in claim 1, further comprising:

a first motor that drives the first hand;

an information display that displays specific information by a second hand; and a second motor that drives the second hand, the circularly polarized patch antenna not overlapping either the first motor or the second motor when seen in plan view from the display surface side of the time display.

3. The electronic timepiece described in claim 1, further comprising:

a digital display that digitally displays information, the circularly polarized patch antenna not overlapping the digital display when seen in plan view from the display surface side of the time display.

4. The electronic timepiece described in claim 1, further comprising:

a solar panel for solar power generation, the solar panel being notched in the part overlapping the circularly polarized patch antenna when seen in plan view from the display surface side of the time display.

5. The electronic timepiece described in claim 1, wherein:

all of the radiating electrode is disposed in the range between 6:00 and 11:00 on the time display.

6. The electronic timepiece described in claim 1, wherein a center of the radiating electrode of the circularly polarized patch antenna being disposed in a range between 6:00 and 11:00 on the time display, and a controller is configured to operate the receiver when a predetermined condition is met.

7. The electronic timepiece described in claim 6, further comprising:

a timekeeper that keeps an internal time, the predetermined condition being the internal time reaching a specific time.

8. The electronic timepiece described in claim 6, further comprising:

an outdoor detector that detects whether or not the electronic timepiece is outdoors, the predetermined condition being the outdoor detector detecting the electronic timepiece is outdoors.

9. The electronic timepiece described in claim 1, further comprising:

an antenna configured to receive a Bluetooth signal.

10. An electronic timepiece comprising:

a time display including a dial and displaying time by the position indicated by a first hand;

a battery;

a circuit board including a notch defined by a shape of the battery, the battery being disposed in the notch; and a circularly polarized patch antenna that receives a satellite signal and includes:

a dielectric substrate having a first surface closest to the dial and a second surface closest to the circuit board, the second surface having a plurality of sides connecting the second surface with the first surface, a radiating electrode disposed on the first surface, a ground electrode disposed on the second surface and electrically connected to the circuit board, the ground electrode being configured to ground the patch antenna, and a feed electrode disposed on the second surface and aligning with a side of the plurality of sides of the dielectric substrate that is closest to a center of the circuit board in plan view from the dial side of the time display, the feed electrode being electromagnetically coupled to the radiating electrode without the use of a feed pin, and the feed electrode being separated from the ground electrode on the second surface by a gap; and a receiver connected to the circularly polarized patch antenna.

* * * * *